United States Patent [19]

Nagashima et al.

[11] 4,148,968

[45] Apr. 10, 1979

[54] RECEIVING SHEET

[75] Inventors: Shinichiro Nagashima, Tokyo; Kaichi Tsuchiya, Fuchu; Yoshihiro Sakamoto; Hiroshi Yamakami, both of Tokyo; Seiji Tomari, Yokohama, all of Japan

[73] Assignee: Canon Kabushiki Kaisha, Tokyo, Japan

[21] Appl. No.: 560,515

[22] Filed: Mar. 20, 1975

Related U.S. Application Data

[62] Division of Ser. No. 293,160, Sep. 28, 1972, Pat. No. 3,880,656.

[51] Int. Cl.[2] ..... B41M 3/12; B41M 5/00

[52] U.S. Cl. ..... 428/454; 428/500; 428/511; 428/524; 428/530; 428/538; 428/539; 428/913

[58] Field of Search ..... 427/150; 428/500, 454, 428/511, 524, 530, 539, 913

[56] References Cited

U.S. PATENT DOCUMENTS

| | | | |
|---|---|---|---|
| 2,425,231 | 8/1947 | Dickerman et al. | 428/539 X |
| 3,185,585 | 5/1965 | Baumann et al. | 427/150 X |
| 3,466,185 | 9/1969 | Taylor | 427/150 X |
| 3,649,357 | 3/1972 | Davis et al. | 427/150 X |
| 3,666,525 | 5/1972 | Kimura et al. | 428/539 X |
| 3,745,672 | 7/1973 | Duskin | 427/150 X |
| 3,833,412 | 9/1974 | Akashi et al. | 428/539 X |
| 3,856,551 | 12/1974 | Jenkins | 427/150 |
| 3,856,553 | 12/1974 | Hayashi et al. | 427/150 X |
| 3,900,216 | 8/1975 | Hayashi et al. | 427/150 X |

*Primary Examiner*—Bernard D. Pianalto

*Attorney, Agent, or Firm*—Fitzpatrick, Cella, Harper & Scinto

[57] ABSTRACT

An electrophotographic method comprises developing an electric latent image formed on a photosensitive member comprising a photoconductive material and containing a first color forming agent in a surface for forming a visible image with a charged toner particle containing a second color forming agent, and heating to cause a thermal color forming reaction therebetween resulting in formation of a colored fixed image on the photosensitive member and a receiving sheet comprising a color forming agent (B) and a material having a melting point from 40° to 130° C.

38 Claims, 7 Drawing Figures

RECEIVING SHEET

This is a division of application Ser. No. 293,160, filed Sept. 28, 1972; now U.S. Pat. No. 3,880,656; Issued on: Apr. 29, 1975.

BACKGROUND OF THE INVENTION

1. Field of the Invention

This invention relates to a novel color forming electrophotographic method utilizing a toner for electrostatic image containing a color forming agent (A) and a photoconductive photosensitive member or an image receiving sheet containing a color forming agent (B), and further to a particular electrophotographic material used therefor.

2. Description of the Prior Art

Heretofore, there have been known various electrophotographic processes such as those disclosed in U.S. Pat. No. 2,297,691, Japanese Patent Publication No. 23910/1967 and Japanese Patent Publication No. 24748/1968. In general, these electrophotographic processes comprise utilizing a photoconductive material, forming electric latent images on a photosensitive member, developing the latent images with a toner, if desired, transferring the developed image to an image receiving sheet such as paper and fixing the transferred image by heating or with solvent vapor.

It is widely known to use, as a developing toner, finely divided particles of 1 - 20 microns in diameter composed of a coloring pigment such as carbon black dispersed in a binder resin such as styrene resin. Such a toner is usually mixed with a carrier material such as glass beads, iron powder, fur and the like, or dispersed in an insulating liquid, and then attracted to or repulsed by the electrostatic latent image to visualize the negative or positive electric image.

The above-mentioned prior art has the following two problems. One is smudging during manufacturing and development since the toner is finely divided black powder. Such finely divided toner is so light that the toner is easily blown up to dirty remarkably hands, feet and clothes as well as room, and further to cause dust pollution outdoors. Dry toner is particularly of high contrast and gives images of high quality, but this dirt problem reduces the usefulness of dry toner.

The other is concerned with fixation. In general, toner is fixed by heating, but when a switch is turned on and then immediately the reproduction operation starts, fixation of the resulting image is incomplete and when rubbed, the toner is easily removed. Thus, the fixed portion is preliminarily heated and brought to a sufficient temperature, and then the reproduction operation can start. Particularly, a necessary preliminary heating time is usually 5 - 10 minutes for dry reproduction machine, and when once the machine is switched on, the fixing device should be kept at a constant temperature until the business time is finished.

As an electrophotographic method using a color forming system, there may be mentioned that disclosed in Japanese Patent Publication No. 15912/1966 which comprises covering a diazonium compound with wax and the like and combining with a paper coated with a coupler, that disclosed in Japanese Patent Publication No. 989/1967 and Japanese Patent Publication No. 3837/1970 which comprises using a volatile first chemical material as toner and a second chemical material (metal salt) as a reproduction sheet to form a colored image. However, when a diazonium compound is used as toner, there is disadvantageously a danger of explosion during pulverizing procedure and further and alkali treatment is necessary upon forming color, and therefore, it is not practical. Furthermore, in a system using a metal salt it is difficult to obtain clear and sharp color.

SUMMARY OF THE INVENTION

An object of this invention is to provide an electrophotographic method which can solve the above-mentioned drawbacks of prior art and in which a toner is colorless or of light color and a completely fixed image can be obtained without any waiting time.

Another object of this invention is to provide a novel multicolor electrophotographic method comprising forming an image on an image receiving sheet containing a color forming agent (B) infra by using a toner for electrostatic image containing a color forming agent (A) infra and applying a color forming treatment to form a visible image.

A further object of this invention is to provide a colorless or light color toner for electrostatic image containing a color forming agent (A) infra which can form color by heating together with a color forming agent (B) infra.

Still another object of this invention is to provide an electrophotographic photosensitive member containing a color forming agent (B) infra capable of forming color by reacting with a color forming agent (A) infra contained in a toner for electrostatic image.

A still further object of this invention is to provide an image receiving sheet containing a color forming agent (B) infra used for transferring an image formed by a toner for electrostatic image containing a color forming agent (A) infra.

Still another object of this invention is to provide an electrostatic transferring paper containing a color forming agent (B) infra.

According to this invention, there is provided an electrophotographic method which comprises developing an electric latent image formed on a photosensitive member comprising a photoconductive material and containing a color forming agent (B) in a surface for forming a visible image with a charged toner particle containing a color forming agent (A), and heating to cause a thermal color forming reaction between the color forming agent (A) in the toner and the color forming agent (B) in the photosensitive member resulting information of a colored fixed image on the photosensitive member, the color forming agent (A) being selected from the group consisting of 1. diarylphthalides,
2. leuco auramines,
3. acryl auramines,
4. $\alpha$, $\beta$ - unsaturated arylketones,
5. basic monoazo dyestuff,
6. rohdamine B lactams,
7. polyarylcarbinols,
8. benzoindolino spiropyranes,
9. phthalans, and
10. spirophthalans, and the color forming agent (B) being selected from the group consisting of 1. polymer of phenol and aldehyde,
2. polymer of phenol and acetylene,
3. rosin modified maleic acid resin,
4. hydrolyzed product of copolymer of styrene and maleinic anhydride, 5. hydrolyzed product of polymer of carboxy polyethylene,
6. hydrolyzed product of copolymer of vinyl methyl ether and maleic anhydride,
7. hydrolyzed product of copolymer of ethylene and maleic anhydride,
8. Japanese acid clay,
9. bentonite,
10. diatomaceous earth,
11. bisphenol compounds containing carboxyl radical in a molecule,
12. polymers of bisphenol compounds containing carboxyl radical in a molecule, and
13. phenolic material.

According to another aspect of this invention, there is provided an electrophotographic method as mentioned above in which the toner particle contains the color forming agent (A) and a color forming auxiliary agent having a melting point ranging from 40 to 130° C. selected from the group consisting of fatty acid, fatty acid metal salt, fatty acid ester, fatty acid amide, fatty acid anilide and solid plasticizer. For the purpose of this invention the expression "solid plasticizer" as employed herein, means diphenyl phthalate, dicyclohexyl phthalate, ethylene glycol, dibenzoate and dimethyl isophthalate. When any of the recording papers, toner particles, photosensitive members, electrostatic recording layers or image receiving sheets is employed with a color forming agent and a color forming auxiliary agent, the solid plasticizer, when employed, is the color forming auxiliary agent.

According to a further aspect of this invention, there is provided an electrophotographic method as mentioned above in which the visible image forming surface of the photosensitive member contains the color forming agent (B) and a color forming auxiliary agent having a melting point ranging from 40 to 130° C. selected from the group consisting of fatty acid, fatty acid metal salt, fatty acid ester, fatty acid amide, fatty acid anilide and solid plasticizer.

According to still another aspect of this invention, there is provided an electrophotographic method which comprises developing an electric latent image formed on a photosensitive member comprising a photoconductive material with a charged toner particles containing a color forming agent (A), transferring the resulting toner image to an image receiving sheet containing a color forming agent (B), and heating to cause a thermal color forming reaction between the color forming agent (A) in the toner and the color forming agent (B) in the photosensitive member resulting in formation of a colored fixed image on the image receiving sheet.

According to a still further aspect of this invention, there is provided an electrophotographic method as mentioned above in which the toner particle contains the color forming agent (A) and a color forming auxiliary agent having a melting point ranging from 40 to 130° C. selected from the group consisting of fatty acid, fatty acid metal salt, fatty acid ester, fatty acid amide, fatty acid anilide and solid plasticizer.

According to still another object of this invention, there is provided an electrophotographic method as mentioned above in which the visable image forming the surface of the photosensitive member contains the color forming agent (B) and a color forming auxiliary agent having a melting point ranging from 40 to 130° C. selected from the group consisting of fatty acid, fatty acid metal salt, fatty acid ester, fatty acid amide, fatty acid anilide and solid plasticizer.

According to a still further aspect of this invention, there is provided an electrostatic recording method which comprises developing an electric latent image formed on an electrostatic recording paper containing a color forming agent (B) in the visible image forming surface with a charged toner particle containing a color forming surface with a charged toner particle containing a color forming agent (A), and heating to cause a thermal color forming reaction the color forming agent (A) in the toner and the color forming agent (B) in the electrostatic recording paper resulting in formation of a color fixed image.

According to a still another aspect of this invention, there is provided an electrostatic recording method as mentioned above in which the toner particle contains the color forming agent (A) and a color forming auxiliary agent having a melting point ranging from 40 to 130° C. selected from the group consisting of fatty acid, fatty acid metal salt, fatty acid ester, fatty acid amide, fatty acid anilide and solid plasticizer.

According to a still further apect of this invention, there is provided an electrostatic recording method as mentioned above in which the visible image forming surface of the photosensitive member contains the color forming gent (B) and a color forming auxiliary agent having a melting point ranging from 40 to 130° C. selected from the group consisting of fatty acid, fatty acid metal salt, fatty acid ester, fatty acid amide, fatty acid anilide and solid plasticizer.

According to still another aspect of this invention, there is provided a recording method which comprises closely contacting a master sheet having a toner image containing a color forming agent (A) with a visible image forming surface containing a color forming agent (B) of an image receiving sheet and heating to cause a thermal color forming reaction between the color forming agent (A) and the color forming agent (B) resulting in a visible image.

According to a still further aspect of this invention, there is provided a recording method as mentioned above in which the toner image contains the color forming agent (A) and a color forming auxiliary agent having a melting point ranging from 4) to 130° C. selected from the group consisting of fatty acid. fatty acid metal salt, fatty acid ester, fatty acid amide, fatty acid anilide and solid plasticizer.

According to still another aspect of this invenion, there is provided a recording method as mentioned above in which the visible image forming surface of an image receiving sheet contains the color forming agent (B) and a color forming auxiliary agent having a melting point ranging from 40 to 130° C. selected from the group consisting of fatty acid, fatty acid metal salt, fatty acid ester, fatty acid amide, fatty acid anilide and solid plasticizer.

According to a still further aspect of this invention there is provided a toner for electrostatic image which comprises containing in a binder resin a color forming agent (A) selected from the group consisting of 1. diarylphthalides,
2. leuco auramines,
3. acryl auramines,
4. $\alpha,\beta$-unsaturated arylketones,
5. basic monoazo dyestuff,
6. rohdamine B lactams,
7. polyarylcarbinols, 8. benzoindolino spiropyranes,
9. phthalans, and
10. spirophthalans.

According to still another aspect of this invention, there is provided a toner for electrostatic image as mentioned above in which the binder resin contains the color forming agent (A) and a color forming auxiliary agent having a melting point ranging from 40° to 130° C. selected from the group consisting of fatty acid, fatty acid metal salt, fatty acid ester, fatty acid amide, fatty acid anilide and solid plasticizer.

According to a still further aspect of this invention, there is provided an electrophotographic photosensitive member which comprises a photoconductive material and a visible image forming surface of the photosensitive member containing a color forming agent (B) selected from the gorup consisting of 1. polymer of phenol and aldehyde,
2. polymer of phenol and acetylene,
3. rosin modified maleic acid resin,
4. hydrolyzed product of copolymer of styrene and maleic anhydride,
5. hydrolyzed product of polymer of carboxy polyethylene,
6. hydrolyzed product of copolymer of vinyl methyl ether and maleic anhydride,
7. hydrolyzed product of copolymer of ethylene and maleic anhydride,
8. Japanese acid clay,
9. bentonite,
10. diatomaceous earth,
11. bisphenol compounds containing carboxyl radical in a molecule,
12. polymers of bisphenol compounds contaning carboxyl radical in a molecule, and
13. phenolic material.

According to still another aspect of this invention, there is provided an electrophotographic photosensitive member as mentioned above in which the visible image forming surface of the photosensitive member contains the color forming agent (B) and a color forming auxiliary agent having a melting point ranging from 40 to 130° C. selected from the group consisting of fatty acid, fatty acid metal salt, fatty acid ester, fatty acid amide, fatty acid anilide and solid plasticizer, According to a still further aspect of this invention there is provided an image receiving sheet which comprises a visible image forming surface containing a color forming agent (B) selected from the group consisting of 1. polymer of phenol and aldehyde,
2. polymer of phenol and acetylene,
3rosin modified maleic acid resin,
4. hydrolyzed product of copolymer of styrene and maleic anhydride,
5. hydrolyzed product of polymer of carboxy polyethylene,
6. hydrolyzed product of copolymer of vinyl methyl ether and maleic anhydride,
7. hydrolyzed product of copolymer of ethylene and maleic anhydride,
8. Japanese acid clay,
9. bentonite,
10. diatomaceous earth,
11. bisphenol compounds containing carboxyl radical in a molecule,
12. polymers of bisphenol compounds contaning carboxyl radical in a molecule, and
13. phenolic material.

According to still another aspect of this invention, there is provided an image receiving sheet as mentioned above in which the visible image forming surface contains the color forming agent (B) and a color forming auxiliary agent having a melting point ranging from 40 to 130° C. selected from the group consisting of fatty acid, fatty acid metal salt, fatty acid ester, fatty acid amide, fatty acid anilide and solid plasticizer.

According to a still further aspect of this invention, there is provided an electrostatic recording paper which comprises a support layer and an electrostatic recording layer overlaying the support layer and containing a color forming agent (B) selected from the group consisting of 1. polymer of phenol and aldehyde,
2. polymer of phenol and acetylene,
3. rosin modified maleic acid resin,
4. hydrolyzed product of copolymer of styrene and maleic anhydride,
5. hydrolyzed product of polymer of carboxy polyethylene,
6. hydrolyzed product of copolymer of vinyl methyl ether and maleic anhydride,
7. hydrolyzed product of copolymer of ethylene and maleic anhydride,
8. Japanese acid clay,
9.bentonite,
10. diatomaceous earth,
11. bisphenol compounds containing carboxyl radical in a molecule,
12. polymers of bisphenol compounds containings carboxyl radical in a molecule, and
13. phenolic material.

According to still another aspect of this invention there is provided an electrostatic recording paper as mentioned above in which the electrostatic recording layer contains the color forming agent (B) and a color forming auxiliary agent having a melting point ranging from 40 to 130° C. selected from the group consisting of fatty acid, fatty acid metal salt, fatty acid ester, fatty acid amide, fatty acid anilide and solid plasticizer.

DESCRIPTION OF THE PREFERRED EMBODIMENTS

Figure 1:
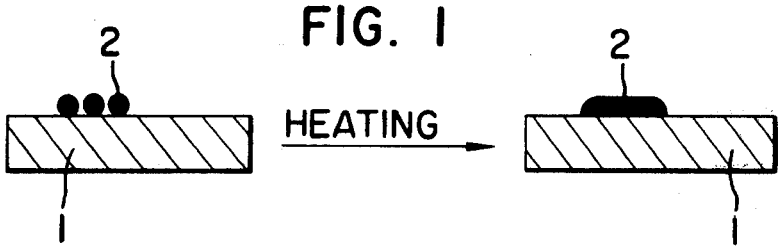
FIG. 1 shows diagrammatically a conventional fixing procedure

The color forming agent (A) used in the present invention is basic material having a color forming group. Representative color forming agents (A) are shown below.

(1) Diaryl phthalides:

3,3-bis(p-dimethylaminophenyl)-6-dimethylamino phthalide (Crystal Violet Lactone),
3,3-bis(p-dimethylaminophenyl)-phthalide (Malachite Green Lactone) and the like.

(2) Leuco auramines;
N - halophenyl derivatives,
N - alkylhalophenyl derivatives,
N - (2,5- dichlorophenyl) leuco auramine, and the like.

(3) Acryl auramines;
N - benzoyl auramine,
N - acetyl auramine, and the like.

(4) $\alpha,\beta$- unsaturated arylketones:
Dianisylidene acetone,
Dibenzylidene acetone,
Anisylidene acetone, and the like.

(5) Basic monoazo dye:
p - dimethylaminoazobenzene - O - carboxylic acid (Methyl Red),
4 - aminoazobenzene (Oil Yellow - AAB),
4 - phenylazo - 1 - naphthylamine, and the like.

(6) Rohdamine B lactams:
N (p-nitrophenyl) - rohdamine B lactam,
3,6'- diamino rohdamine B lactam,
3,6'- diethylamino rohdamine B lactam,
3,6'- dimethylamino rohdamine B lactam, and the like.

(7) Polyaryl carbinols
Bis - (p-dimethylamino phenyl)methanol (Michler's hydrol),
Crystal Violet Carbinol,
Malachite Green Carbinol, and the like.

(8) Benzoindolino spiropyrans:
8'- methoxy benzoindolino spiropyran,
4,7,8'- trimethoxy benzoidolino spiropyran,
6'- chloro - 8'- methoxy benzoindolino spiropyran and the like.

(9) Phthalans:
1,1 - bis (p-aminophenyl) phthalan,
1,1 - bis (p-benzylaminophenyl) phthalan,
1,1 - bis (p-dibenzylamino phenyl) phthalan,
1,1 - bis (p-N-methylanilino phenyl) phthalan, and the like.

(10) Spirophthalans:
6,6'- diamino spiro (phthalan - 1,9'- xanthen)
6,6'- diethylaminospiro (phthalan - 1,9'- xanthen)
6,6'- dimethylamino spiro (phthalan - 1,9'- xanthen) and the like.

These color forming agents (A) can react with the color forming agent (B) as mentioned above to form color. These materials are disclosed in Japanese pat. publication Nos. 10788/1965, 9309/1965, 9310/1965, 3257/1967, 9071/1969, 10318/1969 and 11634/1969.

Among the color forming agents (B) used in this invention, examples of (11) bisphenol compounds containing carboxyl radical in a molecule are:

(1)

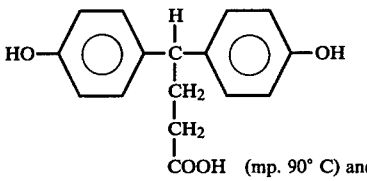

(mp. 90° C) and

-continued (2)

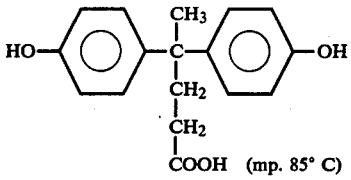

(mp. 85° C)

Further, examples of (12) polymers of bisphenol compounds containing carboxyl radical in a molecule are:

(3)

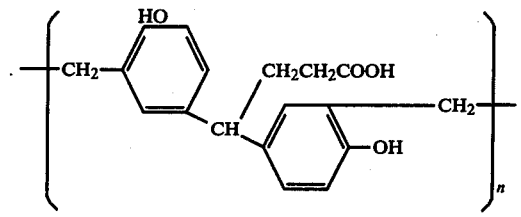

(softening point 95–105° C, average degree of polymerization 30–35) and (4)

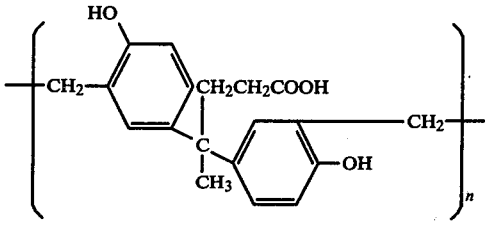

(Softening point 96 – 109° C., overage degree of polymerization 40 – 45). These bisphenol compounds are preferable color forming agents (B).

Furthermore, examples of (B) phenolic material are shown below:

4 - teritary - butyl phenol,
4 - $\beta$ - teritary - amyl phenol,
4 - phenyl phenol,
4,4' - isopropylidine - bis (2-chloro phenol),
4,4' - isopropylidene - bis - (2-methyl phenol),
4,4' - isopropylidene - bis - (2-tertiary butyl phenol),
4,4' - secondary - butylidene - bis -(2-methyl phenol),
2,2'- dihydroxy diphenyl,
4,4' - secondary - butylidene diphenol,
4 - tertiary - octyl catechol,
4 - hydroxy aceto phenone,
methyl - 4 - hydroxy benzoate,
4 - hydroxy diphenoxide,
$\alpha$ - naphthol,
$\beta$ - naphthol,
4 - hydroxy diphenyl oxide,
2,2' -methylene - bis - (4-chloro phenol),
2,2' - methylene - bis - (4-methyl - 6-tertiary-butyl phenol,
4,4' - isopropylidene - bis (2,6-dibromo phenol),
4,4' - isopropylidene - bis - (2,6-dimethyl phenol),
4,4' - cyclohexylidene diphenol,
4,4' - cyclohexylidene - bis - (2-methyl phenol).

The reaction of the color forming agent (A) and the color forming agent (B), a kind of base - acid reaction, according to the present invention, is illustrated by using a combination of malachite green lactone and phenolic resin as an example.

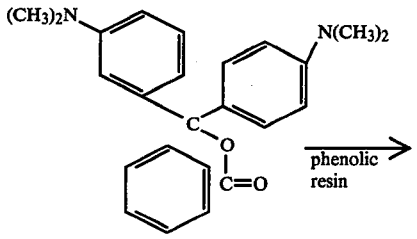

malachite green lactone (MGL)

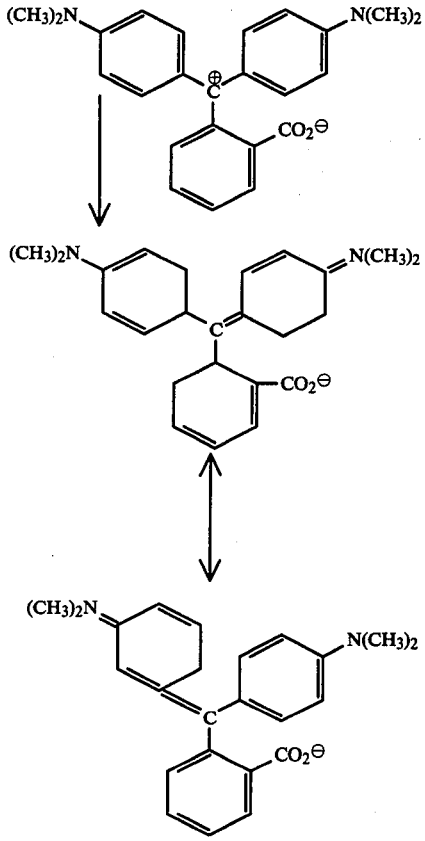

Conventional electrophotographic methods are applicable to the production of electric latent image in the present invention. For example, there may be mentioned conventional elctrophotographic methods such as the Carlson process comprising charging a whole surface of photoconductive layer composed of selenium, Cds or ZnO and then projecting a light image to form a latent image and a method disclosed in Japanese patent publication No. 23910/1967 or 24748/1968 comprising uniformly charging a photosensitive member composed of a photoconductive layer such as selenium and CdS and an insulating layer such as polyester overlying the photoconductive layer, applying corona charging simultaneously with imagewise exposure, and applying blanket exposure.

The latent image thus obtained may be developed by a conventional developing method such as cascade developing methods, magnetic brush developing methods, fur brush developing methods and liquied developing methods, by using a toner having a charge opposite to that of the electrostatic latent image. In some particular cases, there may be used a toner having the same charge as that of the electrostatic latent image.

In the electrophotographic method according to the present invention, when agent (A) alone in a form of finely divided particles, is used as a toner to form an image, the chargeability is poor and fog forms and moreover, the color forming property is poor. Furthermore, there is formed sometimes an image composed of both negative and positive images. The thermal conductivity is so low that melting by heating is not sufficient and color forming efficiency is poor and the density of the resulting image is low. High fixing temperature is necessary and further, the color forming dye directly contacts atmosphere to cause deterioration of the color forming agent (A) due to moisture and oxygen.

The present inventors have successfully eliminated such disadvantages by dispersing the color forming agent (A) in a resin of relatively low melting point such as from 70 to 130° C. which has been used as a binder resin for an electrophotographic toner, such as vinsol resin, cumarone resin, polystyrene, polyvinyl acetate, polyvinyl chloride, polyethylene, polyacrylic acid ester, polyvinyl acetal, polyvinylidene chloride, polyethylene terephthalate, alkyd resin, polyamide resin, epoxy resin, polypropylene, mixtures thereof, and copolymers thereof, the resulting toner for development has a highly improved chargeability.

For the purpose of improving further color forming efficiency and low temperature fixing efficiency, the color forming agent (A) and the binder resin are sufficiently melted at a certain temperature to cause a reaction with the color forming agent (B) on the photosensitive member or the transferring support. It has been now found that addition of a color forming auxiliary agent capable of low temperature fixation and improving the image density to attain the purpose.

The color forming auxiliary agent has a melting point ranging from 40 to 130° C. selected from the group consisting of fatty acid, fatty acid metal salt, fatty acid ester, fatty acid amide, fatty acid anilide and solid plasticizer. These color forming auxiliary agent are mutually soluble with a binder resin, a color forming agent (A) and a color forming agent (B).

Representative color forming auxiliary agents are as shown below. (1) Fatty acids compounds, for example,

| | |
|---|---|
| Lauric acid | (44° C.) |
| Tridecylic acid | (45.5° C.) |
| Myristic acid | (58° C.) |
| Pentadecylic acid | (53 - 54° C.) |
| Palmitic acid | (63 - 64° C.) |
| Heptadecylic acid | (60 - 61° C.) |
| Stearic acid | (71.5 - 72° C.) |
| Nonadecanoic acid | (68.7° C.) |
| Arachic acid | (77° C.) |
| Behenic acid | (81 - 82° C.) |
| Lignoceric acid | (83.5° C.) |
| Cerotic acid | (87.9° C.) |
| Heptacosanoic acid | (82° C.) |
| Montanic acid | (89.3° C.) |
| Melissic acid | (93.5 - 94° C.) |
| Lacceric acid | (95 - 96° C.) |
| and the like. | |

The numbers in the parenthese are melting points. The preferable color forming auxiliary agents are fatty acids containing 12 or more carbon atom and having melting points ranging from 40° to 100° C. (2) Metallic salts of fatty acids having melting points ranging from 40° to 130° C. are shown by the following general formula:

$(RCOO)_nM$ where n = 1 - 3; M is Be, Mg, Ba, Zn, Cd, Hg, Al, Tl, Pb and the like; R is an alkyl radical. Representative examples are as follows:

| | |
|---|---|
| Lead caproate | (m.p. 73 - 74° C.) |
| Lead enanthate | (m.p. 78° C.) |
| Lead caprylate | (m.p. 83 - 84° C.) |
| Lead pelargonate | (m.p. 94 - 95° C.) |
| Lead caprate | (m.p. 100° C.) |
| Lead laurate | (m.p. 106° C.) |
| Lead myristate | (m.p. 108.6° C.) |
| Lead palmitate | (m.p. 112° C.) |
| Lead stearate | (m.p. 116 - 125° C.) |
| Lead tridecylate | (m.p. 128° C.) |
| Aluminum stearate | (m.p. 105° C.) |
| Beryllium stearate | (m.p. 45° C.) |

(3) Fatty acid derivatives having melting points ranging from 40° to 130° C., which are represented by the following formula:

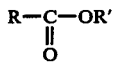

where R is alkyl; R' is alkyl or aryl. Representative examples are as follows:

| | | |
|---|---|---|
| (i) | Methyl esters: | |
| | Methyl arachinate | (m.p. 46 - 47° C.) |
| | Methyl behenate | (m.p. 54° C.) |
| | Methyl lignocerate | (m.p. 56.7 - 57° C.) |
| | Methyl cerotinate | (m.p. 63° C.) |
| | Methyl heptacosanate | (m.p. 64° C.) |
| | Methyl montanate | (m.p. 65.5° C.) |
| | Methyl melissinate | (m.p. 71.5° C.) |
| (ii) | Ethyl esters: | |
| | Ethyl arachinate | (m.p. 42° C.) |
| | Ethyl behenate | (m.p. 50° C.) |
| | Ethyl lignocerate | (m.p. 56.7 - 57° C.) |
| | Ethyl cerotinate | (m.p. 60° C.) |
| | Ethyl montanate | (m.p. 64 - 65° C.) |
| | Ethyl melissinate | (m.p. 70.5° C.) |
| | Ethyl laccerate | (m.p. 76° C.) |
| (iii) | Phenyl esters: | |
| | Phenyl arachinate | (m.p. 58.5° C.) |
| | Phenyl palmitinate | (m.p. 45° C.) |
| (iv) | Glycohol esters: | |
| | Glycohol myristate | (m.p. 64° C.) |
| | Glycohol palmitinate | (m.p. 51 5° C.) |
| | Glycohol stearate | (m.p. 58 - 75° C.) |
| (v) | Glycerol esters | |
| | Glycerol laurate | (m.p. 63° C.) |
| | Glycerol myristate | (m.p. 56 - 70.5° C.) |
| | Glycerol palmitinate | (m.p. 34 - 77° C.) |
| | Glycerol stearate | (m.p. 54 - 71° C.) |

(4) Fatty acid derivatives having melting points ranging from 40° C. to 130° C., which are represented by the following formula

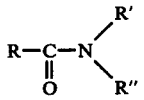

where R is alkyl; R' and R'' is H, alkyl, or aryl. Representative examples useful for this invention are as follows:

| | | |
|---|---|---|
| (i) | Amides: | |
| | Acetic amides | (m.p. 82 - 83° C.) |
| | Propionic amide | (m.p. 81.8° C.) |
| | Butyric amide | (m.p. 115 - 116° C.) |
| | Valeric amide | (m.p. 106° C.) |
| | Caproic amide | (m.p. 101° C.) |
| | Enantic amide | (m.p. 93 - 94° C.) |
| | Caprinic amide | (m.p. 105.9° C.) |
| | Peralgonoic amide | (m.p. 98.9° C.) |
| | Undecylic amide | (m.p. 84.5 - 85.5° C.) |
| | Lauric amide | (m.p. 102.4° C.) |
| | Tridecylic amide | (m.p. 100° C.) |
| | Myristic amide | (m.p. 105.1° C.) |
| | Pentadecylic amide | (m.p. 102° C.) |
| | Palmitic amide | (m.p. 107° C.) |
| | Heptadecylic amide | (m.p. 108 - 109° C.) |
| | Stearic amide | (m.p. 109.7° C.) |
| | Arachic amide | (m.p. 108° C.) |
| | Behenic amide | (m.p. 111 - 112° C.) |
| | Cerotic amide | (m.p. 109° C.) |
| | Montanic amide | (m.p. 112° C.) |
| (ii) | Anilides: | |
| | Valeric amilide | (m.p. 68° C.) |
| | Caproic anilide | (m.p. 92° C.) |
| | Caprylic anilide | (m.p. 55° C.) |
| | Peralgonoic anilide | (m.p. 57.5° C.) |
| | Capric anilide | (m.p. 62.5° C.) |
| | Undecylic anilide | (m.p. 71° C.) |
| | Lauric anilide | (m.p. 77.2° C.) |
| | Myristic anilide | (m.p. 84° C.) |
| | Palmitic anilide | (m.p. 90.2° C.) |
| | Stearic anilide | (m.p. 94° C.) |
| | Behenic anilide | (m.p. 101 - 102° C.) |
| (iii) | N-Methyl amides | |
| | Capric methyl amide | (m.p. 57.8° C.) |
| | Lauric methyl amide | (m.p. 62.4° C.) |
| | Myristic methyl amide | (m.p. 78.4° C.) |
| | Palmitic methyl amide | (m.p. 85.5° C.) |
| | Stearic methyl amide | (m.p. 92.1° C.) |
| (iv) | N-Dodecylic amides | |
| | Lauric dodecyl amide | (m.p. 77 - 77.5° C.) |
| | Myristic dodecyl amide | (m.p. 84 - 85° C.) |
| | Palmitic dodecyl amide | (m.p. 82.5 - 85° C.) |
| | Stearic dodecyl amide | (m.p. 85 - 85.5° C.) |

(5) Solid plasticizers, for example, diphenyl phthalate, dicyclohexyl phthalate, ethylene glycol dibenzoate, and dimethyl isophthalate.

Addition of the color forming auxiliary agent results in high color forming efficiency, good low temperature fixation, and colored image copy having sharp and sufficient density. Such improvement is considered due to that the color forming auxiliary agent melts at relatively low temperature and the color forming agent (A) and the binder resin and further the color forming agent (B) in the photosensitive member or transferring paper are mutually soluble with the color forming auxiliary agent to cause coloring and fixing at a low temperature and enhance the color forming density.

It has been further found from experiments shown later that the color forming auxiliary agent gives a good result when the color forming auxiliary agent is added together with the color forming agent (B) to a visible image forming surface of the electrophotographic photosensitive member or image receiving sheet.

The amount of the color forming auxiliary agent is usually more than 5 parts preferred with 20 - 200 parts, particularly preferred with 30 - 150 parts, per 100 parts of the color forming agent (A).

Figure 2:
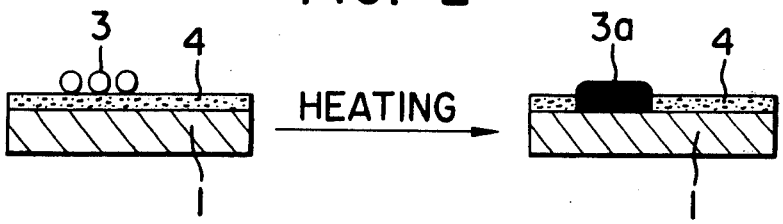
FIG. 2 shown diagrammatically a color forming and fixing procedure according to the present invention.

Now referring to FIG. 1 and FIG. 2, there is explained the difference between coloring and fixation of the present invention and fixation of conventional dry electrophotographic method. According to conventional method, a toner image 2 formed on a support 1 such as paper is already colored before heat-fixation and can be fixed to support 1 by heat-fixing at relatively high temperature. On the contrary, according to the color forming fixing method of the present invention, a color forming agent layer 4 is formed on a support 1 such as paper and a toner image 3 containing a color forming agent (A) formed on the color forming agent layer 4 is colorless or of light color. When these are heated at a relatively low temperature and melted to cause a color forming reaction with a color forming agent (B) layer 4 resulting in the colored portion 3a. As is clear from above, a conventional toner image is often removed by rubbing while a colored image according to the present invention is not removed at all by rubbing.

Figure 3:
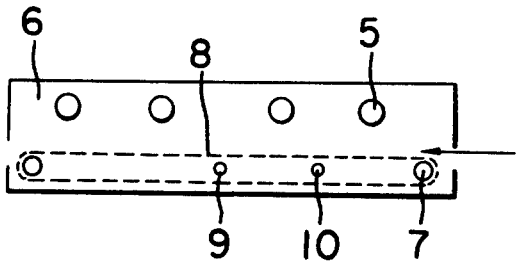
FIG. 3 shows a fixing apparatus.

Conventional dry toner (thermoplastic resin - carbon system) is compared with the toner of the present invention (Example 1) with respect to fixing temperature by using a fixing apparatus as illustrated in FIG. 3.

As shown in FIG. 3, four 250W infrared heaters 5 are arranged and a conveyor 8 of 200 mm long moves at 123 mm/sec. and a transferring sheet moves thereon to form color and fix. Reference numbers 6,7,8,9 and 10 devote a heat insulating material, a gear, a wire net conveyor, a thermometer and a variable thermostat, respectively.

By using this fixing apparatus, each fixing temperature was measured.

| | Fixing temperature |
|---|---|
| Toner of the present invention | 180° C. |
| Conventional toner | 280° C. |

This result indicates that waiting time of a copier can be shortened to a great extent.

The following experimental examples are given for illustrating the improvement accomplished by the present invention. In the experimental examples, ingredients are mixed at the weight ratio as listed in the following tables and melted and cooled, and then pulverized by using a jet mill to form a toner of less than 20 microns in size. Ten parts by weight of the resulting toner was mixed with 90 parts by weight of iron powder of 50 microns in size, and image formation was effected by using NP 1100 Electrophotographic apparatus (manufactured by Cannon Co.) and the resulting image was evaluated.

The evaluation of each experimental example is conducted as shown below.

1. State at normal temperature after mix-melting: Distinguishing solid mater and sticky semi-solid by naked eyes.
2. Pulverizing property: Degree of pulverizing property is designated as shown below;
   ◎ good
   ○ fairly good
   Δ somewhat bad
   X bad
3. Maximum color forming density. Fog density: Reflective density is measured by MACBETH quantalog densitometer RD-100 with a red filter.
4. Image blur, resolving power: Evaluation of images on a transferring paper by naked eyes and the evaluation results are designated in the same way as shown in item 2 above.
5. Chargeability: Mixing an iron powder carrier with a sample toner and measuring polarity of charge, negative or positive.
6. Fixing temperature: Measured by a method as mentioned above. In the following table, "D-125" denotes polystyrene supplied by Esso Standard Co. (trade name, "Piccolastic" D-125) and "CVL" denotes Crystal Violet Lactone.

Table 1

| Experiment No. | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| D-125 | 25 parts | 50 | 70 | 85 | 70 | 70 | 70 | 70 | 70 | 70 | 70 | 70 | 70 | 70 |
| Stearic acid | parts | | | | 5 | 10 | 20 | 30 | 40 | 15 | 15 | 15 | 15 | 15 |
| CVD | 75 parts | 50 | 30 | 15 | 30 | 30 | 30 | 30 | 30 | 5 | 10 | 20 | 40 | 60 |
| State after fusing at room temperature | solid | solid | solid | solid | solid | solid | solid | solid | solid | solid | solid | solid | solid | solid |
| Pulverizing property | Δ | ○ | ◎ | ◎ | ◎ | ◎ | ○ | Δ | × | ◎ | ◎ | ◎ | ○ | ○ |
| Fusing to drum | non | non | non | non | non | non | non | a little | exist | none | none | none | none | a little |
| Chargeability | + | +− | − | − | − | − | − | +− | + | − | − | − | − | +− |
| Fixing temperature | 300° C | 290° | 280° | 270° | 200° | 185° | 175° | 170° | 165° | 170° | 175° | 180° | 200° | 220° |
| Maximum density of formed color | 0.3 | 0.3 | 0.2 | 0.2 | 0.6 | 0.8 | 1.0 | 1.05 | 1.0 | 0.8 | 1.0 | 1.0 | 1.0 | 1.0 |
| Density of fog | 0.01 | 0.01 | 0.01 | 0.01 | 0.02 | 0.03 | 0.04 | 0.05 | 0.07 | 0.02 | 0.03 | 0.03 | 0.05 | 0.08 |
| Blur | exist | exist | none | none | none | none | none | a little | exist | none | none | none | none | a little |
| Resolving power | Δ | Δ | ○ | ○ | ○ | ◎ | ◎ | ○ | ○ | ○ | ◎ | ◎ | ○ | ○ |
| Total evaluation | Δ | Δ | ○ | ○ | ○ | ◎ | ◎ | Δ | Δ | ○ | ◎ | ◎ | ○ | Δ |

Table 2

| Experiment No. | 15 | 16 | 17 | 18 | 19 | 20 | 21 | 22 | 23 | 24 |
|---|---|---|---|---|---|---|---|---|---|---|
| D-125 | 70 | 70 | 70 | 70 | 70 | 70 | 70 | 70 | 70 | 70 |

Table 2-continued

| Experiment No. | 15 | 16 | 17 | 18 | 19 | 20 | 21 | 22 | 23 | 24 |
|---|---|---|---|---|---|---|---|---|---|---|
| Myristic acid | parts 5 | 10 | 20 | 30 | 40 | 15 | 15 | 15 | 15 | 15 |
| CVD | parts 30 | 30 | 30 | 30 | 30 | 5 | 10 | 20 | 40 | 60 |
| State after fusing at room temperature | parts solid | solid | solid | solid | solid | solid | solid | solid | solid | solid |
| Pulverizing property | ◎ | ◎ | ○ | Δ | × | ◎ | ◎ | ◎ | ○ | ○ |
| Fusing to drum | none | none | none | a little | exist | none | none | none | none | a little |
| Charge-ability | − | − | − | +− | + | − | − | − | − | +− |
| Fixing temperature | 210° C. | 205° C. | 190° C. | 185° C. | 180° C. | 170° C. | 175° C. | 180° C. | 180° C. | 195° C. |
| Maximum density of formed color | 0.6 | 0.9 | 1.0 | 1.05 | 1.0 | 0.8 | 1.0 | 1.02 | 1.0 | 1.10 |
| Density of fog | 0.02 | 0.03 | 0.03 | 0.05 | 0.17 | 0.02 | 0.03 | 0.03 | 0.05 | 0.07 |
| Blur | none | none | none | a little | exist | none | none | none | none | a little |
| Resolving power | ○ | ◎ | ◎ | ○ | ○ | ○ | ◎ | ◎ | ○ | ○ |
| Total evaluation | ○ | ◎ | ◎ | ○ | Δ | ○ | ◎ | ◎ | ◎ | Δ |

Table 3

| Experiment No. | 25 | 26 | 27 | 28 | 29 | 30 | 31 | 32 | 33 | 34 |
|---|---|---|---|---|---|---|---|---|---|---|
| D-125 | 70 | 70 | 70 | 70 | 70 | 70 | 70 | 70 | 70 | 70 |
| Aluminum stearate | parts 5 | 10 | 20 | 30 | 40 | 15 | 15 | 15 | 15 | 15 |
| CVL | parts 30 | 30 | 30 | 30 | 30 | 5 | 10 | 20 | 40 | 60 |
| Pulverizing property | ◎ | ◎ | ○ | Δ | × | ◎ | ◎ | ◎ | ○ | ○ |
| Fusing to drum | none | none | none | a little | exist | none | none | none | none | a little |
| Charge-ability | − | − | − | +− | + | − | − | − | − | +− |
| Fixing temperature | 215° C. | 200° C. | 190° C. | 185° C. | 180° C. | 185° C. | 190° C. | 195° C. | 215° C. | 235° C. |
| Maximum density of formed color | 0.58 | 0.81 | 1.97 | 1.00 | 1.02 | 0.79 | 1.01 | 1.00 | 1.01 | 1.03 |
| Density of fog | 0.02 | 0.03 | 0.04 | 0.05 | 0.07 | 0.02 | 0.03 | 0.03 | 0.05 | 0.08 |
| Blur | none | none | none | a little | exist | none | none | none | none | a little |
| Resolving power | ○ | ◎ | ◎ | ○ | ○ | ○ | ◎ | ◎ | ○ | ○ |
| Total evaluation | ○ | ◎ | ◎ | Δ | Δ | ○ | ◎ | ◎ | ○ | Δ |

Table 4

| Experiment No. | 35 | 36 | 37 | 38 | 39 | 40 | 41 | 42 | 43 | 44 | 45 | 46 | 47 | 48 |
|---|---|---|---|---|---|---|---|---|---|---|---|---|---|---|
| D-125 | 25 parts | 50 parts | 70 parts | 85 parts | 70 parts | 70 parts | 70 parts | 70 parts | 70 parts | 70 parts | 70 parts | 70 parts | 70 parts | 70 parts |
| Lead Capylate | | | | | 5 " | 10 " | 20 " | 30 " | 40 " | 15 " | 15 " | 15 " | 15 " | 15 " |
| CVL | 75 " | 50 " | 30 " | 15 " | 30 " | 30 " | 30 " | 30 " | 30 " | 5 " | 10 " | 20 " | 40 " | 60 " |
| Pulverizing property | Δ | ○ | ◎ | ◎ | ◎ | ◎ | ○ | Δ | × | ◎ | ◎ | ◎ | ○ | ○ |
| Fusing to drum | none | none | none | none | none | none | none | a little | exist | none | none | none | none | a little |
| Charge-ability | + | +− | − | − | − | − | − | +− | + | − | − | − | − | +− |
| Fixing temperature | 300° C | 290 | 280 | 270 | 210 | 195 | 185 | 180 | 175 | 180 | 185 | 190 | 210 | 230 |
| Maximum density of formed | 0.27 | 0.30 | 0.20 | 0.25 | 0.63 | 0.87 | 1.09 | 1.05 | 1.00 | 0.81 | 1.02 | 1.05 | 1.00 | 1.07 |

Table 4-continued

| Experiment No. | 35 | 36 | 37 | 38 | 39 | 40 | 41 | 42 | 43 | 44 | 45 | 46 | 47 | 48 |
|---|---|---|---|---|---|---|---|---|---|---|---|---|---|---|
| color | | | | | | | | | | | | | | |
| Density of fog | 0.01 | 0.01 | 0.01 | 0.01 | 0.02 | 0.03 | 0.04 | 0.04 | 0.08 | 0.02 | 0.03 | 0.03 | 0.05 | 0.08 |
| Blur | exist | exist | none | none | none | none | none | a little | exist | none | none | none | none | a little |
| Resolving power | Δ | Δ | ○ | ○ | ○ | ◎ | ◎ | ○ | ○ | ○ | ◎ | ◎ | ○ | ○ |
| Total evaluation | Δ | Δ | ○ | ○ | ○ | ◎ | ◎ | Δ | Δ | ○ | ◎ | ◎ | ○ | Δ |

Table 5

| Experiment No. | 49 | 50 | 51 | 52 | 53 | 54 | 55 | 56 | 57 | 58 | 59 | 60 | 61 | 62 |
|---|---|---|---|---|---|---|---|---|---|---|---|---|---|---|
| D-125 | 25 parts | 50 parts | 70 parts | 85 parts | 70 parts | 70 parts | 70 parts | 70 parts | 70 parts | 70 parts | 70 parts | 70 parts | 70 parts | 70 parts |
| Glycol stearate | | | | | 5 " | 10 " | 20 " | 30 " | 40 " | 15 " | 15 " | 15 " | 15 " | 15 " |
| CVL | 75 " | 50 " | 30 " | 15 " | 30 " | 30 " | 30 " | 30 " | 30 " | 5 " | 10 " | 20 " | 40 " | 60 " |
| Pulverizing property | Δ | ○ | ◎ | ◎ | ◎ | ◎ | ○ | Δ | × | ◎ | ◎ | ◎ | ○ | ○ |
| Fusing to drum | none | none | none | none | none | none | none | a little | exist | none | none | none | none | a little |
| Charge-ability | + | +− | − | − | − | − | +− | + | − | − | − | − | − | +− |
| Fixing temperature | 300° C | 290 | 280 | 270 | 200 | 185 | 175 | 170 | 165 | 170 | 175 | 180 | 200 | 220 |
| Maximum density of formed color | 0.32 | 0.31 | 0.20 | 0.21 | 0.61 | 0.83 | 0.95 | 1.01 | 1.00 | 0.85 | 1.01 | 1.01 | 1.01 | 1.00 |
| Density of fog | 0.01 | 0.01 | 0.01 | 0.01 | 0.02 | 0.03 | 0.03 | 0.05 | 0.07 | 0.02 | 0.03 | 0.05 | 0.08 | |
| Blur | exist | exist | none | none | none | none | none | a little | exist | none | none | none | none | a little |
| Resolving power | Δ | Δ | ○ | ○ | ○ | ◎ | ◎ | ○ | ○ | ○ | ◎ | ◎ | ○ | ○ |
| Total evaluation | Δ | Δ | ○ | ○ | ○ | ◎ | ◎ | Δ | Δ | ○ | ◎ | ◎ | ○ | Δ |

Table 6

| Experiment No. | 63 | 64 | 65 | 66 | 67 | 68 | 69 | 70 | 71 | 72 |
|---|---|---|---|---|---|---|---|---|---|---|
| D-125 | 70 parts | 70 parts | 70 parts | 70 parts | 70 parts | 70 parts | 70 parts | 70 parts | 70 parts | 70 parts |
| Glycol stearate | 5 " | 10 " | 20 " | 30 " | 40 " | 15 " | 15 " | 15 " | 15 " | 15 " |
| CVL | 30 " | 30 " | 30 " | 30 " | 30 " | 5 " | 10 " | 20 " | 40 " | 60 " |
| Pulverizing property | ◎ | ◎ | ○ | Δ | × | ◎ | ◎ | ◎ | ○ | ○ |
| Fusing to drum | none | none | none | a little | exist | none | none | none | none | a little |
| Charge-ability | − | − | − | +− | + | − | − | − | − | +− |
| Fixing temperature | 205° C. | 190 | 180 | 175 | 170 | 175 | 180 | 185 | 205 | 225 |
| Maximum density of formed color | 0.60 | 0.80 | 1.00 | 1.05 | 1.00 | 0.80 | 1.01 | 1.00 | 1.00 | 1.00 |
| Density of fog | 0.02 | 0.03 | 0.04 | 0.05 | 0.07 | 0.02 | 0.03 | 0.03 | 0.05 | 0.08 |
| Blur | none | none | none | a little | exist | none | none | none | none | a little |
| Resolving power | ○ | ○ | ◎ | ○ | ○ | ○ | ◎ | ◎ | ○ | ○ |
| Total evaluation | ○ | ◎ | ◎ | Δ | Δ | ○ | ◎ | ◎ | ○ | Δ |

Table 7

| Experiment No. | 73 | 74 | 75 | 76 | 77 | 78 | 79 | 80 | 81 | 82 |
|---|---|---|---|---|---|---|---|---|---|---|
| D-125 | 70 parts | 70 parts | 70 parts | 70 parts | 70 parts | 70 parts | 70 parts | 70 parts | 70 parts | 70 parts |
| Methyl | 5 " | 10 " | 20 " | 30 " | 40 " | 15 " | 15 " | 15 " | 15 " | 15 " |

Table 7-continued

| Experiment No. | 73 | 74 | 75 | 76 | 77 | 78 | 79 | 80 | 81 | 82 |
|---|---|---|---|---|---|---|---|---|---|---|
| behenate CVL | 30 " | 30 " | 30 " | 30 " | 30 " | 5 " | 10 " | 20 " | 40 " | 60 " |
| Pulverizing property | ◎ | ◎ | ○ | Δ | × | ◎ | ◎ | ◎ | ○ | ○ |
| Fusing to drum | none | none | none | a little | exist | none | none | none | none | a little |
| Charge-ability | − | − | − | +− | + | − | − | − | − | +− |
| Fixing temperature | 190° C. | 175 | 165 | 160 | 155 | 160 | 165 | 170 | 190 | 210 |
| Maximum density of formed color | 0.53 | 0.80 | 0.95 | 1.00 | 1.01 | 0.81 | 1.01 | 1.00 | 1.00 | 1.00 |
| Density of fog | 0.02 | 0.03 | 0.04 | 0.05 | 0.07 | 0.02 | 0.03 | 0.03 | 0.05 | 0.08 |
| Blur | none | none | none | a little | exist | none | none | none | none | a little |
| Resolving power | ○ | ◎ | ◎ | ○ | ○ | ○ | ◎ | ◎ | ○ | ○ |
| Total evaluation | ○ | ◎ | ◎ | Δ | Δ | ○ | ◎ | ◎ | ○ | Δ |

Table 8

| Experiment No. | 83 | 84 | 85 | 86 | 87 | 88 | 89 | 90 | 91 | 92 |
|---|---|---|---|---|---|---|---|---|---|---|
| D-125 | 70 parts | 70 parts | 70 parts | 70 parts | 70 parts | 70 parts | 70 parts | 70 parts | 70 parts | 70 parts |
| Ethyl behenate | 5 " | 10 " | 20 " | 30 " | 40 " | 15 " | 15 " | 15 " | 15 " | 15 " |
| CVL | 30 " | 30 " | 30 " | 30 " | 30 " | 5 " | 10 " | 20 " | 40 " | 60 " |
| Pulverizing property | ◎ | ◎ | ○ | Δ | × | ◎ | ◎ | ◎ | ○ | ○ |
| Fusing to drum | none | none | none | a little | exist | none | none | none | none | a little |
| Charge-ability | − | − | − | +− | + | − | − | − | − | +− |
| Fixing temperature | 190° C. | 175 | 165 | 160 | 155 | 160 | 165 | 170 | 190 | 210 |
| Maximum density of formed color | 0.60 | 0.79 | 1.00 | 1.01 | 1.00 | 0.80 | 1.01 | 1.01 | 1.00 | 1.00 |
| Density of fog | 0.02 | 0.03 | 0.04 | 0.05 | 0.07 | 0.02 | 0.03 | 0.03 | 0.05 | 0.08 |
| Blur | none | none | none | a little | exist | none | none | none | none | a little |
| Resolving power | ○ | ◎ | ◎ | ○ | ○ | ○ | ◎ | ◎ | ○ | ○ |
| Total evaluation | ○ | ◎ | ◎ | Δ | Δ | ○ | ◎ | ◎ | ○ | Δ |

Table 9

| Experiment No. | 93 | 94 | 95 | 96 | 97 | 98 | 99 | 100 | 101 | 102 | 103 | 104 | 105 | 106 |
|---|---|---|---|---|---|---|---|---|---|---|---|---|---|---|
| D-125 | 25 parts | 50 parts | 70 parts | 85 parts | 70 parts | 70 parts | 70 parts | 70 parts | 70 parts | 70 parts | 70 parts | 70 parts | 70 parts | 70 parts |
| Leuric amide | | | | | 5 " | 10 " | 20 " | 30 " | 40 " | 15 " | 15 " | 15 " | 15 " | 15 " |
| CVL | 75 " | 50 " | 30 " | 15 " | 30 " | 30 " | 30 " | 30 " | 30 " | 5 " | 10 " | 20 " | 40 " | 60 " |
| Pulverizing property | Δ | ○ | ◎ | ◎ | ◎ | ◎ | ○ | Δ | × | ◎ | ◎ | ◎ | ○ | ○ |
| Fusing to drum | none | none | none | none | none | none | none | a little | exist | none | none | none | none | a little |
| Charge-ability | + | +− | − | − | − | − | − | +− | + | − | − | − | − | +− |
| Fixing temperature | 300° C. | 290 | 280 | 270 | 225 | 210 | 200 | 195 | 185 | 195 | 200 | 205 | 225 | 245 |
| Maximum density of formed color | 0.30 | 0.30 | 0.20 | 0.20 | 0.60 | 0.80 | 1.00 | 1.05 | 1.01 | 0.8 | 1.00 | 1.02 | 1.01 | 1.00 |
| Density of fog | 0.01 | 0.01 | 0.01 | 0.01 | 0.02 | 0.03 | 0.04 | 0.05 | 0.07 | 0.02 | 0.03 | 0.03 | 0.05 | 0.08 |
| Blur | exist | exist | none | none | none | none | none | a little | exist | none | none | none | none | a little |

Table 9-continued

| Experiment No. | 93 | 94 | 95 | 96 | 97 | 98 | 99 | 100 | 101 | 102 | 103 | 104 | 105 | 106 |
|---|---|---|---|---|---|---|---|---|---|---|---|---|---|---|
| Resolving power | Δ | Δ | ○ | ○ | ○ | ◎ | ◎ | ○ | Δ | ○ | ◎ | ◎ | ○ | ○ |
| Total evaluation | Δ | Δ | ○ | ○ | ○ | ◎ | ◎ | Δ | Δ | ○ | ◎ | ◎ | ○ | Δ |

Table 10

| Experiment No. | 107 | 108 | 109 | 110 | 111 | 112 | 113 | 114 | 115 | 116 |
|---|---|---|---|---|---|---|---|---|---|---|
| D-125 | 70 parts | 70 parts | 70 parts | 70 parts | 70 parts | 70 parts | 70 parts | 70 parts | 70 parts | 70 parts |
| Leuric anilide | 5 " | 10 " | 20 " | 30 " | 40 " | 15 " | 10 " | 20 " | 40 " | 60 |
| CVL | 30 " | 30 " | 30 " | 30 " | 30 " | 15 " | 10 " | 20 " | 40 " | 60 " |
| Pulverizing property | ◎ | ◎ | ○ | Δ | × | ◎ | ◎ | ◎ | ○ | ○ |
| Fusing to drum | none | none | none | a little | exist | none | none | none | none | a little |
| Charge-ability | − | − | − | +− | + | − | − | − | − | +− |
| Fixing temperature | 200 | 185 | 175 | 170 | 165 | 170 | 175 | 180 | 200 | 200 |
| Maximum density of formed color | 0.57 | 0.81 | 1.05 | 1.01 | 1.00 | 0.87 | 0.95 | 1.03 | 1.05 | 1.01 |
| Density of fog | 0.02 | 0.02 | 0.04 | 0.04 | 0.07 | 0.02 | 0.03 | 0.04 | 0.05 | 0.07 |
| Blur | none | none | none | a little | exist | none | none | none | none | a little |
| Resolving power | ○ | ◎ | ◎ | ○ | ○ | ○ | ◎ | ◎ | ○ | ○ |
| Total evaluation | ○ | ◎ | ◎ | Δ | Δ | Δ | ◎ | ◎ | ○ | Δ |

Table 11

| Experiment No. | 117 | 118 | 119 | 120 | 121 | 122 | 123 | 124 | 125 | 126 |
|---|---|---|---|---|---|---|---|---|---|---|
| D-125 | 70 parts | 70 parts | 70 parts | 70 parts | 70 parts | 70 parts | 70 parts | 70 parts | 70 parts | 70 parts |
| Leuric N-methyl amide | 5 " | 10 " | 20 " | 30 " | 40 " | 15 " | 15 " | 15 " | 15 " | 15 " |
| CVL | 30 " | 30 " | 30 " | 30 " | 30 " | 5 " | 10 " | 20 " | 40 " | 60 " |
| Pulverizing | ○ | ○ | ○ | Δ | × | ○ | ○ | ○ | ○ | ○ |
| Fusing to drum | none | none | none | a little | exist | none | none | none | none | a little |
| Charge-ability | − | − | − | +− | + | − | − | − | − | +− |
| Fixing temperature | 195 | 180 | 170 | 165 | 160 | 165 | 170 | 175 | 195 | 215 |
| Maximum density of formed color | 0.6 | 0.75 | 1.00 | 1.05 | 1.01 | 0.81 | 1.01 | 1.00 | 1.05 | 1.02 |
| Density of fog | 0.02 | 0.03 | 0.04 | 0.05 | 0.07 | 0.02 | 0.03 | 0.03 | 0.05 | 0.07 |
| Blur | none | none | a little | exist | none | none | none | none | a little | |
| Resolving power | ○ | ◎ | ◎ | ○ | ○ | ○ | ◎ | ◎ | ○ | ○ |
| Total evaluation | ○ | ◎ | ◎ | Δ | Δ | ○ | ◎ | ◎ | ○ | Δ |

Table 12

| Experiment No. | 127 | 128 | 129 | 130 | 131 | 132 | 133 | 134 | 135 | 136 |
|---|---|---|---|---|---|---|---|---|---|---|
| D-125 | 70 parts | 70 parts | 70 parts | 70 parts | 70 parts | 70 parts | 70 parts | 70 parts | 70 parts | 70 parts |
| Leuric dodecyl amide | 5 " | 10 " | 20 " | 30 " | 40 " | 15 " | 15 " | 15 " | 15 " | 15 " |
| CVL | 30 " | 30 " | 30 " | 30 " | 30 " | 5 " | 10 " | 20 " | 40 " | 60 " |
| Pulverizing property | ◎ | ◎ | ○ | Δ | × | ◎ | ◎ | ◎ | ○ | ○ |

Table 12-continued

| Experiment No. | 127 | 128 | 129 | 130 | 131 | 132 | 133 | 134 | 135 | 136 |
|---|---|---|---|---|---|---|---|---|---|---|
| Fusing to drum | a little | a little | a little | a little | exist | none | none | none | none | a little |
| Chargeability | − | − | − | +− | + | − | − | − | − | +− |
| Fixing temperature | 200 | 185 | 175 | 170 | 165 | 170 | 175 | 180 | 200 | 220 |
| Maximum density of formed color | 0.55 | 0.81 | 1.01 | 1.03 | 1.05 | 0.80 | 1.01 | 1.00 | 1.00 | 1.02 |
| Density of fog | 0.02 | 0.03 | 0.04 | 0.05 | 0.07 | 0.02 | 0.03 | 0.03 | 0.05 | 0.07 |
| Blur | none | none | none | a little | none | none | none | none | none | a little |
| Resolving power | ○ | ◎ | ◎ | ○ | ○ | ○ | ◎ | ◎ | ○ | ○ |
| Total evaluation | ○ | ◎ | ◎ | Δ | Δ | Δ | ◎ | ◎ | ○ | Δ |

The above results indicate that increasing the amount of a charge controlling resin (styrene polymer and the like) to a color forming auxiliary agent results in lowering of color forming efficiency and low temperature fixing efficiency so that any satisfactory image can not be obtained. As the added amount of a color forming auxiliary agent increases to the charge controlling resin, the controlling effect is lowered and blur is formed at detailed portion of image and image quality is lowered though low temperature fixation proceeds further.

As the added amount of a color forming agent (A) is increased with respect to a charge controlling resin, the controlling effect is lowered in a manner similar to a color forming auxiliary agent and the color forming efficiency is not increased as much.

The surface of a photosensitive member or image receiving sheet used in this invention is treated with a color forming agent (B), and if desired, a mixture with a color forming auxiliary agent and a binder.

The color forming agent (B) and a mixture with a color forming auxiliary agent may be applied to a photosensitive member or image receiving sheet by spraying, electrostatic coating, soaking, fluidizing bed coating, brushing, roll coating and any optical conventional method.

A small amount of a binder may be used for adhering the formulation of the present invention to surface of a photosensitive member or image receiving sheet. Representative binders are styrene-butadiene latex, polyvinylpyrrolidone, acryl latex, PVA, polyvinyl acetate copolymer and mixtures thereof. Conventional additives such as antioxidant, emulsifier, polishing agent, solvent, surfactant, dispersing agent, antifoaming agent, and coloring agent. The amount of binder is preferably less than about 20% based on the weight of a mixture of a color forming agent (B) and a color forming auxiliary agent since effective color forming and fixation can be effected when the toner contacts a large amount of mixture of color forming agent (B) and color forming auxiliary agent at the surface of the image receiving sheet to which the toner is fixed.

Paper sheet or web is usually used as an image receiving sheet. The paper may be composed of organic or inorganic fiber such as cellulose, modified cellulose polymerizable resin, glass, and asbestos fiber.

In the following, there are shown experimental example illustrating the effect and function of a color forming auxiliary agent at an image receiving sheet surface.

With respect to phenol-aldehyde polymer as acidic polymer material and stearic acid as fatty acid at various ratio, there were determined fixing temperature and color forming density. The result is shown in Table 13. This result is almost similar to other polymers and fatty acids.

When a fatty acid such as stearic acid is used in a small amount, the color forming and fixing temperature is high. On the contrary, when the ratio of stearic acid increases, stearic acid remarkably penetrates into an image receiving sheet upon melting of stearic acid and the paper becomes transparent. A serious drawback caused by increased amount of stearic acid is that the color forming density is low. The optimum point where low temperature fixation is possible and no transparency occurs and further the color forming density is high is at a ratio of a color forming auxiliary agent to a color forming agent (B) being 5 – 40 parts, preferably, 10 – 30 parts: 50 parts. A result of using a solid plasticizer in place of fatty acid is shown in Table 14. Solid plasticizer does not cause transparency even when the amount of solid plasticizer is high, and the color forming density becomes fairly low.

Optimum ratio of solid plasticizer to color forming agent (B) is 5– 40 parts, preferred with 10 – 30 parts, : 50 parts.

In a similar way, there were determined fixing temperature and color forming density when phenol-aldehyde polymer was used as acidic polymer material of an image receiving sheet and aluminum stearate as fatty acid metal salt. The result is shown in Table 15. It has been found that this result is almost the same as in case of other polymers and other fatty acid metal salts. When the amount of a fatty acid metal salt such as aluminum stearate is little, the color forming and fixing temperature is high. On the contrary, when the amount of aluminum stearate increases, there is a drawback that the color forming density is low.

An appropriate addition amount of fatty acid metal salt capable of giving low temperature fixing effect as well as high color forming density ranges from 5 to 40 parts, preferred with from 10 to 30 parts per 50 parts of color forming agent (B).

Table 16 shows a result obtained by using monoglycerol stearate, a kind of fatty acid ester, as color forming auxiliary agent.

The optimum mixing ratio is the same as that for fatty acid.

Table 17 shows a result obtained by using tridecylic acid amide, a kind of fatty acid amide, as color forming auxiliary agent. The optimum ratio is the same as that for fatty acid metal salt.

Table 18 shows a result in case of using diphenylbutyric acid as color forming agent (B).

Table 13

| | | | | | | | | | |
|---|---|---|---|---|---|---|---|---|---|
| Phenol-Aldehyde Polymer (color forming agent B) | 50 parts | 50 parts | 50 parts | 50 parts | 50 parts | 50 parts | 50 parts | 50 parts | 50 parts |
| Stearic acid (color forming auxiliary agent) | 0" | 5" | 10" | 20" | 30" | 40" | 50" | 60" | 70" |
| Styrene- Butadiene Latex (Low 686) | 20" | 20" | 20" | 20" | 20" | 20" | 20" | 20" | 20" |
| Water | 150" | 150" | 150" | 150" | 150" | 150" | 150" | 150" | 150" |
| Sodium salt of treated resin (Dresinate X) | 0.4" | 0.4" | 0.4" | 0.4" | 0.4" | 0.4" | 0.4" | 0.4" | 0.4" |
| Fixing Temperature C.V.L. toner | 280° C. | 270° C. | 240° C. | 200° C. | 190° C. | 170° C. | 160° C. | 160° C. | 160° C. |
| Fixing Temperature CVI + styrene toner | 270 | 260 | 240 | 200 | 180 | 170 | 160 | 160 | 160 |
| Image density | 1.2 | 1.2 | 1.2 | 1.1 | 1.1 | 0.9 | 0.8 | 0.8 | 0.8 |
| Note | high color forming temperature, good image | high color forming temperature, good image | good image | good image | good image | An image receiving sheet becomes transparent | An image receiving sheet becomes transparent | An image receiving sheet becomes transparent | An image receiving sheet becomes transparent |

Table 14

| | | | | | | | | | |
|---|---|---|---|---|---|---|---|---|---|
| Phenol-Aldehyde Polymer (color forming agent B) | 50 50 parts | 50 50 parts | 50 50 parts | 50 50 parts | 50 50 parts | 50 50 parts | 50 50 parts | 50 50 parts | 50 50 parts |
| EGDB (color forming auxiliary agent) | 0" | 5" | 10" | 20" | 30" | 40" | 50" | 60" | 70" |
| Sytrene-Butadiene Latex (Now 686) | 20" | 20" | 20" | 20" | 20" | 20" | 20" | 20" | 20" |
| Water | 150" | 150" | 150" | 150" | 150" | 150" | 150" | 150" | 150" |
| Sodium salt of treated resin (Dresinate X) | 0.4" | 0.4" | 0.4" | 0.4" | 0.4" | 0.4" | 0.4" | 0.4" | 0.4" |
| Fixing Temperature C.V.L. toner | 280° C. | 270° C. | 260° C. | 210° C. | 190° C. | 180° C. | 160° C. | 160° C. | 160° C. |
| Fixing Temperature CVL + styrene toner | 270 | 260 | 250 | 200 | 180 | 170 | 150 | 150 | 150 |
| Image density | 1.2 | 1.2 | 1.2 | 1.1 | 1.0 | 0.8 | 0.6 | 0.6 | 0.6 |
| Note | high color forming temperature, good image | high color forming temperature, good image | high color forming temperature, good image | good image | good image | low image density | low image density | low image density | low image density |

Table 15

| | | | | | | | | | |
|---|---|---|---|---|---|---|---|---|---|
| Phenol-Aldehyde Polymer (color forming agent B) | 50 parts | 50 parts | 50 parts | 50 parts | 50 parts | 50 parts | 50 parts | 50 parts | 50 parts |
| Alminium stearate (color forming auxiliary agent) | 0" | 5" | 10" | 20" | 30" | 40" | 50" | 60" | 70" |
| Styrene-Butadiene Latex (Low 686) | 20" | 20" | 20" | 20" | 20" | 20" | 20" | 20" | 20" |
| Water | 150" | 150" | 150" | 150" | 150" | 150" | 150" | 150" | 150" |
| Sodium salt of treated resin (Dresinate X) | 0.4" | 0.4" | 0.4" | 0.4" | 0.4" | 0.4" | 0.4" | 0.4" | 0.4" |
| C.V.L. | | | | | | | | | |

Table 15-continued

| | | | | | | | | | | |
|---|---|---|---|---|---|---|---|---|---|---|
| Phenol-Aldehyde Polymer (color forming agent B) | | 50 parts | 50 parts | 50 parts | 50 parts | 50 parts | 50 parts | 50 parts | 50 parts | 50 parts |
| Fixing Temperature | toner | | | | | | | | | |
| | CVL + styrene toner | 270 | 260 | 240 | 200 | 180 | 170 | 160 | 160 | 160 |
| Image density | | 1.2 | 1.2 | 1.2 | 1.1 | 1.1 | 0.8 | 0.7 | 0.7 | 0.7 |
| Note | | high color forming temperature, good image | high color forming temperature, good image | good image | good image | good image | low image density | low image density | low image density | low image density |

Table 16

| | | | | | | | | | | |
|---|---|---|---|---|---|---|---|---|---|---|
| Phenol-Aldehyde Polymer (color forming agent B) | | 50 parts | 50 parts | 50 parts | 50 parts | 50 parts | 50 parts | 50 parts | 50 parts | 50 parts |
| Monoglyceral stearate (color forming auxiliary agent) | | 0" | 5" | 10" | 20" | 30" | 40" | 50" | 60" | 70" |
| Styrene-Butadiene Latex (Low 686) | | 20" | 20" | 20" | 20" | 20" | 20" | 20" | 20" | 20" |
| Water | | 150" | 150" | 150" | 150" | 150" | 150" | 150" | 150" | 150" |
| Sodium salt of rosin | | 0.4" | 0.4" | 0.4" | 0.4" | 0.4" | 0.4" | 0.4" | 0.4" | 0.4" |
| Fixing Temperature | C.V.L. toner | 280 | 270 | 200 | 190 | 160 | 160 | 160 | 160 | 160 |
| | CVL + styrene toner | 270 | 260 | 200 | 180 | 150 | 150 | 150 | 150 | 150 |
| Dnox | | 1.2 | 1.2 | 1.2 | 1.2 | 1.2 | 0.9 | 0.8 | 0.8 | 0.8 |
| Note | | high color forming temperature, high fixing temperature | high color forming temperature, high fixing temperature | high color forming temperature, low fixing temperature | high color forming temperature, low fixing temperature | high color forming temperature, low fixing temperature | low image density | low image density | low image density | low image density |

Table 17

| | | | | | | | | | | |
|---|---|---|---|---|---|---|---|---|---|---|
| Phenol-Aldehyde Polymer (color forming agent B) | | 50 parts | 50 parts | 50 parts | 50 parts | 50 parts | 50 parts | 50 parts | 50 parts | 50 parts |
| Tridecylic acid amide (color forming auxiliary agent) | | 0" | 5" | 10" | 20" | 30" | 40" | 50" | 60" | 70" |
| Styrene-Butadiene Latex (Dow 686) | | 20" | 20" | 20" | 20" | 20" | 20" | 20" | 20" | 20" |
| Water | | 150" | 150" | 150" | 150" | 150" | 150" | 150" | 150" | 150" |
| Sodium salt of treated rosin (Bresinate X) | | 0.4" | 0.4" | 0.4" | 0.4" | 0.4" | 0.4" | 0.4" | 0.4" | 0.4" |
| Fixing Temperature | C.V.L. toner | 280° C. | 270° C. | 260° C. | 210° C. | 190° C. | 180° C. | 160° C. | 160° C. | 160° C. |
| | CVL + styrene toner | 270 | 260 | 250 | 200 | 180 | 170 | 150 | 150 | 150 |
| Image density | | 1.2 | 1.2 | 1.2 | 1.1 | 1.0 | 0.8 | 0.6 | 0.6 | 0.6 |
| Note | | high color forming temperature, good image | high color forming temperature, good image | high color forming temperature, good image | good image | good image | low image density | low image density | low image density | low image density |

Table 18

| | | | | | | | | | | |
|---|---|---|---|---|---|---|---|---|---|---|
| DPBA (color forming agent B) | | 50 parts | 50 parts | 50 parts | 50 parts | 50 parts | 50 parts | 50 parts | 50 parts | 50 parts |
| Stearic acid (color forming auxiliary agent) | | 0" | 5" | 10" | 20" | 30" | 40" | 50" | 60" | 70" |
| Styrene-Butadiene Latex (Dow 686) | | 20" | 20" | 20" | 20" | 20" | 20" | 20" | 20" | 20" |
| Water | | 150" | 150" | 150" | 150" | 150" | 150" | 150" | 150" | 150" |
| Sodium salt of treated rosin (Dresinate X) | | 0.4" | 0.4" | 0.4" | 0.4" | 0.4" | 0.4" | 0.4" | 0.4" | 0.4" |
| Fixing Temperature | C.V.L. toner | 28° C. | 270° C. | 240° C. | 200° C. | 190° C. | 170° C. | 160° C. | 160° C. | 160° C. |
| | CVL + styrene toner | 270 | 260 | 240 | 200 | 180 | 170 | 160 | 160 | 160 |
| Image density | | 1.2 | 1.2 | 1.2 | 1.1 | 1.1 | 0.9 | 0.8 | 0.8 | 0.8 |
| Note | | high color forming temperature, good image | high color forming temperature, good image | good image | good image | good image | An image receiving sheet becomes transparent | An image receiving sheet becomes transparent | An image receiving sheet becomes transparent | An image receiving sheet becomes transparent |

The image receiving sheet used for determining the data in the above tables was prepared by coating an aqueous dispersion liquid of a color forming agent (B), a color forming auxiliary agent, styrene-butadiene latex and Dresinate X on a high quality paper in the thickness of 2 - 3 microns. The image density shows an optical density, and "CVL" is Crystal Violet Lactone.

In the image receiving sheet of the present invention, a mixture of a color forming agent (B) and a color forming auxiliary agent may be added to the paper at an optional step of paper making. In case of coating the mixture, the resulting coating containing a mixture of a color forming agent (B) and a color forming auxiliary agent of 2 - 20 g., preferred with 5 - 10 g. (as solid) per 1 $m^2$ can lower the color forming and fixing temperature to a great extent. An amount less than that range also has such effect, but results in low color forming density and irregular coating. On the contrary, when an amount more than that range is used, the fixing temperature increases and curl occurs.

When a mixture of a color forming agent (B) and a color forming auxiliary agent is incorporated in paper during beater step or is impregnated in paper after the web is formed, a fairly large amount of the mixture should be present at the surface of paper sheet. In this case, a good result is obtained when the mixture of 10 - 20 g. per 1 $m^2$ of an image receiving sheet is applied to the image receiving surface as a surface coating.

An example of a printing process using an electrophotographic method of the present invention is explained below.

There may be used, as a printing master sheet, a developed image which is obtained by developing an electrostatic latent image on an electrophotographic photosensitive member with a toner containing a color forming agent (A) of the present invention. Further, an image obtained by transferring to a transferring member may also be used as a printing master sheet. The master sheet is contacted with an image receiving sheet containing a color forming agent (B) and heated to cause a thermal color forming reaction of a color forming agent (A) with a color forming agent (B) resulting in a visible image. This process can be repeatedly conducted by using a new image receiving sheet to produce many sheets of reproduction.

Figure 4:
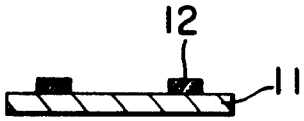
FIG. 4 shows diagrammatically a cross sectional view of a master sheet according to the present invention.

Referring to the drawing, the above process is explained further in detail. A master sheet is prepared by forming an image containing a color forming agent (A) on a surface of a support such as paper, film, electrophotographic photosensitive plate and the like. Referring to FIG. 4, there is illustrated an embodiment of a master sheet. A toner image 12 containing a color forming agent (A) is formed on a paper, film or electrophotographic photosensitive plate 11.

Figure 5:
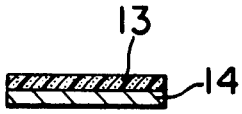
FIG. 5 shows diagrammatically a cross sectional view of a printing member used in the present invention.

Referring to FIG. 5, there is shown a printing member in which a color forming agent (B) layer 13 is provided on an appropriate support 14 such as paper, cloth, film and the like.

Figure 6:
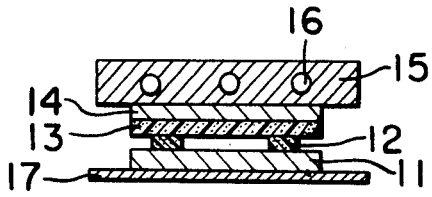
FIG. 6 shows diagrammatically a procedure for reproducing an image by using a master sheet of FIG. 4 and a print member of FIG. 5.
Figure 7:
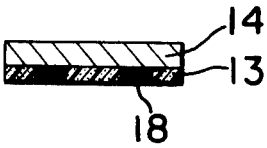
FIG. 7 shows diagrammatically a reproduction obtained in FIG. 6.

Referring to FIG. 6, the master sheet in FIG. 4 and the printing member in FIG. 5 are used for reproduction. A master sheet 11, 12 is placed on a plate 17 and a printing member 13, 14 is placed on the master sheet by facing the color forming agent (B) layer to the toner image of the master sheet. A box 15 composed of glass or a thermally conductive material provided with a heater 16 such as infrared ray heater, nichrome wire heater and the like is pressed to the printing member. Thus, a thermal reaction is caused to produce color forming images 18 as shown in FIG. 7. In other words, a part of image containing a color forming agent (A) is absorbed into a layer containing a color forming agent (B) of the printing member, transferred thereto and a color forming reaction occurs to form a colored image by pressing and heating. Further, many reproductions can be obtained by repeating the above-mentioned procedure.

Images containing a color forming agent (A) may be produced by various methods. For example, an image is written by hand using an ink containing a color forming agent (A). An image can be formed by an electrophotographic process. A photoconductive photosensitive member, e.g. photoconductive zinc oxide paper, is charged and exposed by a known method, and then subjected to dry development by a magnetic brush method or cascade developing method using a toner containing a color forming agent (A) or wet development by a liquid developer composed of toner containing a color forming agent (A) dispersed in an isoparaffin high insulating liquid. The resulting toner images produced on the zinc oxide paper is used as a master sheet. The light image as used in the above procedure for exposure is a mirror image with respect to the original image.

A photoconductive layer of a photoconductive selenium photosensitive drum or a photoconductive zinc oxide photosensitive drum is charged and exposed by a known method and developed with dry developer by a known magnetic brush or cascade developing method. The resulting toner image can be used as a master sheet, or the toner image transferred to an other sheet may be used as a master sheet.

A photoconductive selenium photosensitive plate or photoconductive zinc oxide layer is charged, exposed by a known method, and developed with a toner containing a color forming agent (A) dispersed in an isoparaffin high insulating carrier, and the image thus developed or the developed image further transferred to an other sheet can be used as a master sheet.

A selective dicharging is applied to a photoconductive layer, such as selenium layer, having an insulating film, and a dry or liquid developer containing a color forming agent (A) is used for development. The resulting toner image can be used as a master sheet.

According to the above printing methods, it is possible to produce many sheets of multicolor printing. In a recording method using a thermal color forming reaction of a color forming agent (A) with a color forming agent (B), a plurality of master sheets corresponding to spectrally divided color which has a toner image containing a color forming agent (A) capable of producing a color corresponding to each spectral color. These master sheets are sequentially pressed to a printing member having a color forming agent (B) containing surface and heated by heating at least one of the master sheet and the printing member.

An example of color heat sensitive printing method is as shown below. Master sheets are prepared by an electrophotographic means. Usually, three master sheets i.e. red, blue and green master sheets, corresponding to three divided visible spectra, are prepared.

First photoconductive photosensitive layer sheet after charged is exposed to a light image through a red filter and developed with a color forming agent (A) capable of giving cyan color. Second photoconductive photosensitive layer sheet after charging is exposed to a light image through a green filter and developed with a color forming agent (A) capable of giving magenta color. Third photoconductive photosensitive layer sheet after charging is exposed to a light image through a blue filter and developed with a color forming agent (A) capable of giving yellow color. The resulting three sheets are used as master sheets. Then, these three master sheets are sequentially pressed to a printing paper containing a color forming agent (B) and heated by using an apparatus as shown in FIG. 6. According to the above mentioned method, fusing color forming is effected by heating so that a mixed color can be obtained since the later formed color does not suppress the former formed color.

According to the above mentioned method, a complicated and expensive printing machine is not necessary, and many sheets of reproduction can be easily and quickly obtained.

The resulting printed matter is of high density and good quality.

A color forming agent (A) and a color forming agent (B) are usually separated from each other so that the printed matter is stable against light and heat as compared with conventional heat sensitive reproduction.

The following examples are given for illustrating the present invention, but should not be construed as limiting the present invention.

EXAMPLE 1

Crystal Violet lactone was ground into a particle size of 1 - 50 microns, preferably, 5 - 20 microns, by an attritor. The particles over 325 mesh sieve was removed from the toner material by sieving. To the resulting toner was added iron powder at a ratio of 8 - 50 weight parts, preferably, 10 - 20 weight parts per one part of the toner. The iron powder was 20 - 70 microns, preferably, 25 - 40 microns in particle size. A negative charge was applied uniformly to the whole surface of a photoconductive zinc oxide, and then the surface was exposed to a light pattern to produce an electrostatic latent image. The latent image was developed with the mixture of iron powder and toner, by means of magnetic brush in a developing apparatus. The toner particles adhered to the negatively charged image portion.

The phenolic resin (available as trade name, Tamanol 510 from Arakawa Rinsan K.K.; mp. 80° C.) was mixed and ground with a suitable binder, e.g. styrene-butadiene-latex rubber. The mixture was applied onto a paper to form a coating of about 5 microns thick. The sheet thus formed was used as an image receiving sheet.

The toner image was transferred to the image receiving sheet. Then, the sheet was subjected to a color forming fixing by the fixing apparatus shown in FIG. 3 to produce a blue image. The color-forming initiated at a temperature of about 100° C. while the fixing was completed at a temperature of about 180° C. in case of Crystal Violet lactone.

In the following examples, preparation procedure, particle sizes of the toner, carrier, and contents of the developing agent were similar to those of Example 1.

EXAMPLE 2

Malachite Green lactone (MGL) was used as a toner and iron powder as a carrier.

A photoconductive drum having a selenium layer as a photosensitive member was subjected to charging and exposure by a conventional technique and developed with the above-prepared developing agent by a magnetic brush. The toner particles adhered to the image portion negatively charged.

P-tert-amyl phenol was mixed and ground with styrene butadiene latex, and polyvinyl pyrrolidone in water by a ball-mill. The resulting mixture was applied to a paper to form a coating of about 5 microns thick. The sheet thus formed was used as an image receiving sheet. The toner image on a selenium drum was transferred to the image receiving sheet, followed by subjecting to heat color forming fixing. The green image was obtained where a color forming fixing temperature was about 180° C., and color formation initiated at about 110° C.

EXAMPLE 3

Rhodamine in leuco-base (RL) was used as a toner, and iron powder as a carrier. The process was similar to that of Example 2, and the image receiving sheet was that of Example 1. The color forming fixing temperature was 180° C. to result in a red image.

EXAMPLE 4

Leuco-auramine was used as a toner, and iron powder as a carrier. The process of image forming was similar to that of Example 2.

An image receiving sheet was made from phenolic resin available as trade name, PP811 from Cunei Chemical Co., dissolved in xylol and a base paper. The color forming fixing temperature was about 180° C. to result in a sharp yellow image.

EXAMPLE 5

80 parts of Crystal Violet lactone (CVL) was dissolved in 20 parts of myristic acid, and fused. The melted mixture was poured into a shallow pan to cool and solidify. The material was ground in an attritor into a size of 1 - 50 microns, preferably, 5 - 20 microns. The particles over 325 mesh sieve was removed from the toner. To the thus sieved toner was added an iron powder at a ratio of 8 - 50 weight parts, preferably, 10 - 20 weight parts per one weight part of the toner. The iron particles were the range of 20 - 75 microns, preferably, 25 - 40 microns in size. The mixture of iron particles and the toner were introduced into a magnetic brush type developing apparatus. The whole surface of photoconductive zinc oxide was negatively charged, and exposed to a light pattern to form a latent image, which was developed by a developing apparatus. The toner particles adhered to the image portion negatively charged. The above formed toner image was transferred to an image receiving sheet having a coating made from a phenolic resin with a suitable binder. Then, heat color forming fixing was carried out. The toner comprising 80 parts of CVL and 20 parts of myristic acid can be fixed at about 110° C. while the toner comprising only CVL needed a temperature of about 180° C.

In the following examples, the toner was produced by a similar procedure of Example 4, to use for developing a latent image.

EXAMPLE 6

Toner: CVL 80 parts, palmitic acid 20 parts
Carrier: iron powder
Color forming fixing temperature: 110° C.

EXAMPLE 7

Toner: Malachite Green lactone (MGL) 50 parts, Stearic acid 50 parts
Carrier: iron powder
Color forming fixing temperature: 100° C.

EXAMPLE 8

Toner: benzoyl leuco methylene blue (BLMB) 95 parts, erucic acid 5 parts
Carrier: iron powder
Color forming fixing temperature: 110° C.

EXAMPLE 9

Toner: Leuco-auramine 50 parts, behenic acid 50 parts
Carrier: iron powder
Color forming fixing temperature: 130° C.

EXAMPLE 10

Toner: Rhodamine in leuco-base 50 parts, diacetone acryl amide (DAAM) 50 parts
Carrier: iron powder
Color forming fixing temperature: 90° C.

EXAMPLE 11

Toner: CVL 50 parts, ethylene glycol dibenzoate 50 parts
Carrier: iron powder
Color forming fixing temperature: 100° C.

EXAMPLE 12

Toner: Malachite Green lactone (MGL) 30 parts, dicyclohexyl phthalate (DCHP) 60 parts
Carrier: iron powder
Color forming fixing temperature: 110° C.

EXAMPLE 13

Toner: Crystal Violet lactone (CVL) 50 parts, Rhodamine in leuco-base 50 parts
Carrier: iron powder
Color forming fixing temperature: 180° C.
Color: purple

EXAMPLE 14

80 Parts of 8'-methoxy indolino spiropyrane and 20 parts of stearic acid were mixed and fused. The fused mixture was poured into a pan to cool and solidify. The solidified material was crushed by a hammer mill crusher, and then ground by a jet mill into fine powder of a size having 1 - 50 microns, preferably, 5 - 20 microns. Iron powder was added to the thus formed toner at a ratio of 8 - 50 weight parts, preferably, 10 - 20 weight parts per one part of the toner. The iron powder was 20 - 75 microns, preferably, 25 - 40 microns in size. The mixture of iron powder and toner, i.e., the developing agent was introduced into a developing apparatus of magnetic brush type. The whole surface of photoconductive zinc oxide was negatively charged, and exposed to a light and dark pattern to form a latent image, which was developed by a developing apparatus. The toner adhered to the image portion negatively charged.

Then, the toner image thus formed was transferred to an image receiving sheet having a coating of phenolic resin with suitable binder. The heat color forming fixing was carried out. The toner comprising 80 parts of 8'-methoxy indolino spiropyrane and 20 parts of stearic acid fixed at a temperature of about 110° C. to result in a dark blue image.

EXAMPLE 15

70 Parts of styrene resin (available as a trade name Piccolastic D-125 from Esso Standard Oil), 15 parts of stearic acid, 20 parts of Crystal Violet lactone (CVL) and 20 parts of Erogyl #200 (silica available from Nippon Erogyl) were mixed and fused, and then ground by a jet mill into a size below 5 microns to produce a toner. To 100 g. of the toner was added 1 l of Isopar H (trade name; petroleum solvent available from Esso Standard Oil), and ground for a period of 1.5 hours by means of an attritor, into particles having a size of 1 - 2 microns. To 50 ml. of this concentrated liquid was added 2 l of Isopar H and sufficiently ground to prepare a developing agent.

Following the electrophotographing process disclosed in Japanese Pat. Publication No. 23910/1967, a latent image was formed on an insulating layer and developed with the developing agent thus produced to form a toner image.

Styrene-butadiene copolymer latex 20 weight % as a binding agent, Dresinate X (available from Hercules Corp.) 0.3 weight % as an emulsifier, and phenolic aldehyde polymer (of fine particles of about 1 - 3 microns in size) 79.7 weight % as a color forming agent (B) were dispersed in water, and applied to a high quality paper to form a dried coating of 10 g. per square meter. On the formed receiving sheet was the powder image transferred, and heated at about 180° C.to completely fix the image on the sheet. The resultant image was blue and clear. This image could not be vanished even when rubbed with a rubber eraser.

EXAMPLE 16 70 Parts of styrene resin (trade name Piccolastic D-125 available from Esso Standard Oil, mp. 90 - 125°C.), 15 parts of palmitic acid and 20 parts of Rhodamine lactone (available from Hodogaya Chemical Co., Ltd.) were mixed and ground in a vibrating mill crusher. The mixture was uniformly melted, followed by cooling to solidify. The solid mixture was crushed by hammer mill crusher, and ground with a jet mill crusher into the particles of the size of 1 - 50 microns, preferably, 5 - 20 microns. To the afforded powder, i.e., the toner, was added iron powder i.e. a carrier and mixed at a ratio of 3 - 30 weight parts, preferably, 5 - 10 weight parts per one part of the toner. The carrier was 20 - 75 microns, preferably, 25 - 50 microns in particle size. In the mixture of the carrier and the toner, that is, in the developing agent, the carrier was positively charged and the toner was negatively charged.

To a polyethylene terephthalate film (100 microns thick) undercoated with gelatine was applied a quaternary ammonium polymer (trade name CP-261, available from Calgon Corp.) to impart conductivity, and sufficiently dried. Further, to this coating was applied a 5% solution of polyvinyl carbazole in monochlorobenzene solvent sensitized with Crystal Violet by a roller to form a photoconductive coating. Still further, an 8% solution of polyvinyl carbazole 10 parts and phenolic aldehyde polymer 8 parts in monochlorobenzene solvent was applied to the photoconductive film thus formed by a roller to form a coating of 4 - 6 g. per square meter.

The photoconductive film was uniformly charged with a corona discharger, and then, exposed to a light pattern to form a latent image, which was developed by the toner. The afforded powder image was melt-heated to result in a red and complete image. This image was appropriate for an overhead projector.

EXAMPLE 17

70 Parts of styrene resin (trade name Piccolastic D-125, available from Esso Standard Oil; softing point 90 - 125°C.), 15 parts of myristic acid and 20 parts of Malachite Green lactone (MGL) were mixed and ground in a vibrating mill crusher. The mixture was uniformly melted to cool into solid. The solid mixture was crushed by a hammer crusher, and then, ground with a jet mill crusher into the particles of 1 - 50 microns, preferably, 5 - 20 microns in size. To the produced fine powder, that is, the toner, was added iron powder, that is, a carrier at a ratio of 3 - 30 weight parts, preferably, 5 - 10 weight parts per one part of the toner. The carrier was 20 - 75 microns, preferably 25 - 50 microns in particle size. In the mixture of the carrier and the toner, that is, in the developing agent, the carrier was positively charged and the toner negatively charged.

The latent image produced on an insulating layer by the electrophotographic process disclosed in Japanese Pat. Publication No. 24748/1968 was developed with the developer produced above by means of magnetic brush technique to form a toner image.

Styrene butadiene copolymer latex 20 weight % as a binder, Dresinate X (available from Hercules Corp.) 0.3 weight % as an emulsifier and rosin-modified maleic acid polymer (fine powder) 79.7 weight % as a color-forming agent (B) were dispersed in water, and the dispersion mixture was applied to a high quality paper of 50 -60 g./m$^2$ to form a dried coating of 10 g. per square meter. To the receiving sheet thus produced was transferred the powder image and heated at a temperature of about 180° C. to result in a green sharp image with complete fixation. The resultant image was not erased when rubbed vigorously with a rubber eraser.

EXAMPLE 18

70 Parts of styrene resin (trade name, Piccolastic D-125, available from Esso Standard Oil; softening point 90 - 125°C.), 15 parts of stearic acid, 9 parts of Crystal Violet lactone (CVL), 8 parts of Rhodamine lactone (RL), 8 parts of Malachite Green lactone (MGL) and 9 parts of leuco auramine were mixed and ground in a vibrating mill crusher. The mixture was uniformly melted and cooled to solidify.

The solid mixture was crushed by a hammer mill crusher, and then, ground by a jet mill grinder into a particle size of 1 - 50 microns, preferably, 5 - 20 microns. To the afforded fine powder was added an iron powder i.e. a carrier at a ratio of 3 - 30 weight parts, preferably, 5 - 10 weight parts per one weight part of the toner. The carrier was 20 - 75 microns, preferably 25 - 50 microns in particle size. In this mixture of the carrier and the toner, that is, in the developing agent, the carrier was positively charged and the toner negatively charged.

The electrostatic latent image produced by charging uniformly a photoconductive surface of selenium deposited on an aluminum plate and exposing the surface to a light pattern was developed by the developer thus produced to form a toner image. The toner image was transferred to a transferring sheet which was made by the process wherein 10 parts of ethylene maleic anhydride copolymer hydrolyzed product was dissolved in 100 parts of methyl ethyl ketone, the mixture was permeated into a high grade paper to incorporate at a ratio of 5 g./m$^2$. The sheet was heated to form color in the portion to which the toner image was transferred. The resultant image was blue sharp with complete fixing. The resultant image was not vanished even when rubbed strongly with a rubber eraser.

EXAMPLE 19

70 Parts of styrene-methyl ester of acrylate copolymer (in a molar ratio of 6 : 4) (softening point 100 - 130° C.), 15 parts of montanic acid, and 20 parts of Crystal Violet lactone (CVL) were mixed and ground by a vibrating mill grinder. The mixture was sufficiently fused and cooled to solidify. The solid material was crushed by a hammer mill crusher and ground by a jet mill grinder into the particle size of 1 - 50 microns, preferably, 5 - 20 microns. To the resulting toner was added an iron powder, i.e., carrier at a ratio of 3 - 30 weight parts, preferably, 5 - 10 weight parts per one part of the toner. The carrier was 20 - 75 microns, preferably, 25 - 50 microns in a particle size. The carrier was positively charged and the toner negatively charged in the mixture of carrier and toner, i.e., a developing agent.

A corona charge was applied uniformly to a photoconductive member prepared by depositing selenium on an aluminum plate, nd then the member was exposed to a light pattern to form an electrostatic latent image, which was developed with the above produced developing agent to form a toner image. The toner image was transferred on a transferring sheet which was prepared by the process wherein 10 parts of ethylene-maleic anhydride copolymer hydrolyzed product was dissolved in 100 parts of methyl ethyl ketone, and the solution soaked in a high grade paper at the ratio of 5 g./m$^2$. The transferring sheet was heated at about 180° C. to form blue color in the portion where the toner image was transferred. The resultant copy was clear and completely fixed. The resultant image was not vanished when rubbed strongly with an eraser.

EXAMPLE 20

Seventy parts of copolymer of styrene - maleic acid - methyl ester of acrylate (6:1.5:2.5 mole, softening point 95 - 135° C.), 20 parts of stearic acid and 20 parts of Crustal Violet Lactone (CVL) were mixed and ground by a vibrating mill grinder. The said mixture was sufficiently fused and cooled to solidify.

The said solidified material was crushed by a hammer mill crusher, and then ground a jet mill grinder until the particle size became 1 - 50 microns. preferably 5 - 20 microns.

One weight part of the said fine powder (i.e. toner) was mixed with 3 - 30 weight parts, preferably 5 - 10 weight parts, of an iron powder, i.e. carrier.

The particle size of the said carrier is 20 - 75 microns, preferably 25 - 50 microns.

The carrier was positively charged and the toner was charged negatively in the mixture of the said carrier and toner, i.e. a developing agent.

Then the electrostatic latent image obtained by corona-charging and applying a light pattern to a photoconductor composed of selenium vacuum deposited on an aluminum plate was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer hydrolyzed product (a finely divided material) as a color forming agent (B) in water on a high grade paper (50 - 60 g./m$^2$) until the weight of a dried solid of the said material became 5 g., was heated at about 140° C. and a portion to which the toner image was transferred formed blue color, and as the result, a completely fixed clear copy was obtained. The said image was not vanished at all by strong rubbing.

EXAMPLE 21

Seventy parts of copolymer resin of vinyl chloride and vinyl acetate (in a ratio of 91 molar % and 9 molar %) 30 parts of stearic acid and 20 parts of Crystal Violet Lactone (CVL) were mixed and ground by a vibrating mill grinder. The said mixture was sufficiently fused and cooled to solidify.

The said solidified material was crushed by a hammer mill crusher, and then ground a jet mill grinder until the particle size became 1 - 50 microns, preferably 5 - 20 microns.

One weight part of the said fine powder (i.e. toner) was mixed with 3 - 30 weight parts, preferably 5 - 10 weight parts, of an iron powder, i.e. carrier.

The particle size of the said carrier is 20 - 75 microns, preferably 25 - 50 microns.

The carrier was positively charged and the toner was charged negatively in the mixture of the said carrier and toner, i.e. a developing agent.

Then the electrostatic latent image obtained by corona-charging and applying a light pattern to a photoconductor layer composed of ZnO - binder was developed by the above mentioned developing agent to form a toner image. The said toner image was transferred to a transferring paper prepared by coating a composition obtained by dispersing 20 weight % of styrene-butadiene copolymer latex as a binder and 0.3 weight % of Dresinate X (trade mark, manufactured by Hercules Co.) as an emulsifier and 797 weight % of vinyl methyl ether - maleic anhydride copolymer hydrolyzed product (a finely divided material) as a color forming agent (B) in water on a high grade paper (50 - 60 g/m2) until the weight of a dried solid of the said material became to 7 g., was heated at about 180° C. and a portion to which the toner image was transferred formed blue color, and as the result, a completely fixed clear copy was obtained. The said image was not vanished at all by strong rubbing.

EXAMPLE 22

Seventy parts of vinyl chloride-propylene copolymer (70:30 molar %), 20 parts of lacceric acid and 30 parts of Crystal Violet Lactone (CVL) were mixed and ground by a vibrating mill grinder. The said mixture was sufficiently fused and cooled to solidify.

The said solidified material was crushed by a hammer mill crusher, and then ground by a jet mill grinder until the particle size became 1 - 50 microns, preferably 5 - 20 microns.

One weight part of the said fine powder (i.e. toner) was mixed with 3 - 30 weight parts, preferably 5 - 10 weight parts, of an iron powder, i.e. carrier.

The particle size of the said carrier is 20 - 75 microns, preferably 25 - 50 microns.

The carrier was positively charged and the toner was charged negatively in the mixture of the said carrier and toner, i.e. a developing agent.

1.0 Part of acrylic resin, 4 parts of zinc oxide and 2 parts of phenol-aldehyde polymer were dispersed together with xylene-toluene (50:50) mixture solvent in a ball mill for a period of 24 hours, further the addition of the above solvent until the viscosity of 80-100 c.p. to form a coating liquid. The coating liquid was applied to ZnO-acrylic resin sheet to form a coating of 4 - 5 g/m$^2$. A corona charging was applied to this ZnO sheet, further exposed to a light pattern to form an electrostatic latent image, which was developed with the above toner. The obtained powder image was heated at the temperature of about 180° to result in a blue image with complete fixing.

EXAMPLE 23

Seventy parts of styrene resin (Piccolastic D-100 manufactured by ESSO Standard Oil Co.) 15 parts of stearic acid and 30 parts of 8'-methoxy indolino spiropyrane were mixed and ground by a vibrating mill grinder.

The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 30–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on the insulating layer by the electrophotography process disclosed in Japanese Pat. Publication No. 23910/1967 was developed by the above mentioned developing agent by means of magnetic brush technique to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer (a finely divided material) as a color forming agent (B) in water on a high grade paper (50–60 g/m2) until the weight of a dried solid of the said material became to 15 g., was heated at about 180° C. and a portion to which the toner image was transferred formed dark blue color, and as the result, a completely fixed clear copy was obtained. The said image was not vanished at all by strong rubbing.

EXAMPLE 24

Seventy parts of styrene resin (Piccolastic D-100 manufactured by ESSO Standard Oil Co.), 15 parts of lacceric acid and 20 parts of 6.6′-diamino spire (phthalane 1.9′ xanthene) were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the electrophotography process disclosed in Japanese Pat. Publication No. 23910/1967 was developed by means of magnetic brush technique by the above mentioned developing agent to form a toner image. The said toner image was transferred to a transferring paper prepared by coating a composition obtained by dispersing a solution of 10 parts of phenol-acetylene polymer in 100 parts of methyl ethyl ketone, in a ratio of 5 g/m$^2$ on a high grade paper was heated at about 195° C. and a portion to which the toner image was transferred formed red color, and as the result, a completely fixed clear copy was obtained. The said image was not vanished at all by strong rubbing with an eraser.

EXAMPLE 25

Seventy parts of styrene resin (Piccolastic D-125, manufactured by ESSO Standard Oil Co.), 15 parts of lauric acid and 20 parts of 1.1-bis (p-aminophenyl) pathalan were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained by corona-charging and applying a light pattern to a photo-conductor composed of selenium vacuum deposited on an aluminum plate was developed by the above mentioned developing agent to form a toner image. The said toner image was transferred to a transferring paper prepared by coating a composition obtained by dispersing 20 weight % of styrene-butadiene copolymer latex as a binder and 0.3 weight % of Dresinate X (trade mark, manufactured by Hercules Co.) as an emulsifier and 79.7 weight % of carboxy polyethylene polymer hydrolyzed product (a finely divided material) as a color forming agent (B) in water on a high grade paper (50–60) g/m$^2$) until the weight of a dried solid of the said material became to 10 g., was heated at about 160° C. and a portion to which the toner image was transferred formed purple color, and as the result, a completely fixed clear copy was obtained. The said image was not vanished at all by strong rubbing with an eraser.

EXAMPLE 26

Employing the process of Example 15, but substituting for Crystal Violet Lactone (CVL) each N-(2,5-dichrophenyl) leuco auramine, N-acetyl auramine, and dianisylidene acetone, there were obtained the similar result to Example 15.

EXAMPLE 27

Employing the process of Example 15, but substituting for styrene resin, each vinyl chloride resin, vinylidene chloride resin, polyethylene, polypropylene, epoxy resin, the toner chargable negatively was produced. There were obtained the similar results to Example 15.

EXAMPLE 28

Seventy parts of styrene resin (Piccolastic D-125, manufactured by ESSO Standard Oil Co.), 15 parts of lead caprylate and 20 parts of Crystal Violet Lactone (CVL) were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by an electrophotography process disclosed in Japanese Pat. Publication No. 23910/1967 was developed by the above mentioned developing agent by means of magnetic brush technique, to form a toner image. The said toner image was transferred to a transferring paper prepared by coating a composition obtained by dispersing 20 weight % of styrene-butadiene copolymer latex as a binder and 0.3 weight % of Dresinate X (trade mark, manufactured by Hercules Co.) as an emulsifier and 797 weight % of carboxy polyethylene polymer (a finely divided material) as a color forming agent (B) in water on a high grade paper (50–60 g/m$^2$) until the weight of a dried solid of the said material became to 10 g., was heated at about 190° C. and a portion to which the toner image was transferred formed blue color, and as the result, a completely fixed clear copy was obtained. The said image was not vanished at all by strong rubbing.

EXAMPLE 29

Seventy parts of styrene resin (Piccolastic D-125, manufactured by ESSO Standard Oil Co.), 15 parts of aluminum stearate (mp. 105°C.) and 20 parts of Rhodamine lactone were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the electrophotography process disclosed in Japan Pat. Publication No. 23910/1967 was developed by the above mentioned developing agent by means of a magnetic brush technique to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer (a finely divided material) as a color forming agent (B) in water on a high grade paper (50–60 g/m$^2$) until the weight of a dried solid of the said material became to 10 g., was heated at about 195° C. and a portion to which the toner image was transferred formed red color, and as the result, a completely fixed clear copy was obtained. The said image was not vanished at all by strong rubbing.

EXAMPLE 30

Seventy parts of styrene resin (Piccolastic D-125 manufactured by ESSO Standard Oil Co.), 15 parts of lead laurate and 20 parts of Malachite Green Lactone were mixed and ground by a vibrating mill grinder. The said mixture was sufficiently fused and cooled to solidify. The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the electrophotography process disclosed in Japanese Pat. Publication No. 23910/1967 was developed by the above mentioned developing agent by means of magnetic brush technique to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of rosin modified maleic acid polymer (a finely divided material) as a color forming agent (B) in water on a high grade paper (50–60 g/m$^2$) until the weight of a dried solid of the said material became to 5 g., was heated at about 170° C. and a portion to which the toner image was transferred formed green color, and as the result, a completely fixed clear copy was obtained. The said image was not vanished at all by strong rubbing with a rubber eraser.

EXAMPLE 31

Seventy parts of styrene resin (Piccolastic D-125, manufactured by ESSO Standard Oil Co.), 15 parts of lead caprylate, 20 parts of Crystal Violet Lactone (CVL) and 10 parts of Erogyl (trade name, available from Nippon Erogyl Corp.) were mixed and ground by a vibrating mill grinder. The said mixture was sufficiently fused and cooled to solidify. The said solidified material was crushed by a hammer mill crusher, and then ground by a jet mill grinder until the particle size was below 5 microns.

100 G. of this toner was sufficiently ground in 1l of Isoper H by an atomizer into the particle size of 1–2 microns. This concentrated liquid was sufficiently dispersed in 2l of Isoper H to prepare a developing agent.

Then the electrostatic latent image obtained on an insulating layer by the electrophotography process disclosed in Japanese Pat. Publication No. 24748/1968 was developed by the above mentioned developing agent to form a toner image. The said toner image was transferred to a transferring paper prepared by coating a composition obtained by dispersing 20 weight % of styrene-butadiene copolymer latex as a binder and 0.3 weight % of Dresinate X (trade mark, manufactured by Hercules Co.) as an emulsifier and 79.7 weight % of styrene-maleic anhydride copolymer hydrolyzed produce (a finely divided material) as a color forming agent (B) in water on a high grade paper (50–60 g/m$^2$) until the weight of a dried solid of the said material became to 8 g., was heated at about 170° C and a portion to which the toner image was transferred formed blue color, and as the result, a completely fixed clear copy was obtained. The said image was not vanished at all by strong rubbing with a rubber eraser.

EXAMPLE 32

Seventy parts of styrene resin (Piccolastic D-125, manufactured by ESSO Standard Oil Co.), 15 parts of lead enanthylate and 20 parts of Crystal Violet Lactone (CVL) were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained by corona-charging and applying a light pattern to a photoconductor composed of selenium vacuum deposited on an alminium plate was developed by the above mentioned developing agent to form a toner image. The said toner image was transferred to a transferring paper prepared by coating of a composition obtained by dispersing 20 weight % of styrene butadien copolymer latex as a binder and 0.3 weight % of Dresinate X (trade mark, manufactured by Hercules Co.) as an emulsifier and 79.7 weight % of ethylene maleic anhydride copolymer hydrolyzed product (a finely divided material) as a color forming agent (B) in water on a high grade paper (50–60 g/m$^2$) until the weight of a dried solid of the said material became to 10 g., was heated at about 180° C. and a portion to which the toner image was transferred formed blue color, and as the result, a completely fixed clear copy was obtained. The said image was not vanished at all by strong rubbing with a rubber eraser.

EXAMPLE 33

Seventy parts of styrene resin (Piccolastic D-100, manufactured by ESSO Standard Oil Co.), 10 parts of beryllium stearate (mp. 45° C.) 20 parts of Crystal Violet Lactone (CVL) were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained by corona-charging and applying a light pattern to a photoconductor composed of selenium vacuum deposited on an alminium plate was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer hydrolyzed product (a finely divided material) as a color forming agent (B) in water on a high grade paper (50–60 g/m$^2$) until the weight of a dried solid of the said material became to 7 g., was heated at about 190° C. and a portion to which the toner image was transferred formed blue color, and as the result, a completely fixed clear copy was obtained. The said image was not vanished at all by strong rubbing with a rubber eraser.

EXAMPLE 34

Seventy parts of styrene resin (Piccolastic D-125, manufactured by ESSO Standard Oil Co.), 30 parts of leau palmitate (mp. 112° C.) and 20 parts of Rhodamine lactone (RL, available from Hodogaya Chemical Co., Ltd.) were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the said carrier and toner, i.e. a developing agent.

Then the electrostatic latent image obtained by corona-charging and applying a light pattern to a photoconducting layer of ZnO-binder was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of vinyl methyl ether - maleic anhydride copolymer hydrolyzed product (a finely divided material, about 1–3 microns) as a color forming agent (B) in water on a high grade paper (50–60 g /m$^2$) until the weight of a dried solid of the said material became to 10 g., was heated at 185° C and a portion to which the toner image was transferred formed red color, and as the result, a completely fixed clear copy was obtained. The said image was not vanished at all by strong rubbing with a rubber eraser.

EXAMPLE 35

Seventy parts of vinyl chloride-propylene copolymer, 20 parts of Crystal Violet lactone (CVL) were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One wight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by means of the electrophotography process disclosed in Japan Pat. Publication No. 23910/1967 was developed by the above mentioned developing agent to form a toner image. The said toner image was transferred to a transferring paper prepared by coating a composition obtained by dispersing 20 weight % of styrene-butadien copolymer latex as binder and 0.3 weight % of Dresinate X (trade mark, manufactured by Hercules Co.) as an emulsifier and 79.7 weight % of phenol-acetylene polymer (a finely divided material) as a color forming agent (B) in water on a high grade paper (50–60 g/m$^2$) until the weight of a dried solid of the said material became to 3 g., was heated at about 180° C. and a portion to which the toner image was transferred formed blue color, and as the result, a completely fixed clear copy was obtained. The said image was not vanished at all by strong rubbing with a rubber eraser.

EXAMPLE 36

Seventy parts of styrene resin (Piccolastic D-125, manufactured by ESSO Standard Oil Co.), 15 parts of lead tridecylate and 30 parts of 8′-methoxy indolino spiropyran were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the electrophotography process disclosed in Japanese Pat. Publication No. 23910/1967 was developed by the above mentioned developing agent by means of magnetic brush technique, to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer product (a finely divided material as a color forming agent (B) in water on a high grade paper (50–60 g/m$^2$) until the weight of a dried solid of the said material became to 10 g., was heated at about 180° C. and a portion to which the toner image was transferred formed dark blue color, and as the result, a completely fixed clear copy was obtained. The said image was not vanished at all by strong rubbing with a rubber eraser.

EXAMPLE 37

70 Parts of styrene resin Piccolastic D-125), 15 parts of lead palmitate, 20 parts of 6,6′-diamino spiro (phthalan 1,9′-(xanthene) and 10 parts of Erogyl 200 (trade name, silica available from Nippon Erogyl Corp.) were mixed and grounded by a vibration mill grinder. The mixture was uniformly fused and cooled to solidify. The solidified material was crushed by a hammer mill, and then ground by a jet mill grinder into the particle size below about 5 microns. The toner 100 g. was mixed uniformly and with 1 l. of Isopar H (trade name) in an attrator, into the toner particle size of 1–2 microns. This concentrated liquid 50 ml. was uniformly dispersed and in 2 l. of Isapar H (trade name) to prepare a developing agent.

A polyethylene terephthalate film undercoated with gelatine (100 microns thick) was subjected to a conducting treatment with a quaternary ammonium polymer (available as trade name CP-261 from Calgon Corp.)

An 8% solution of brominated polyvinyl carbazole and phenol acetone polymer at a ratio of 10 parts and 7 parts, in a monochlorobenzone was applied on the conductized coating layer by a roller to form an additional coating of about 3–4 g/m$^2$.

The photoconductive film was charged by a corona discharging, and then, exposed to a light pattern to form an electrostatic latent image, which was developed by the toner thus formed. The toner image obtained was heated to result in a red image with complete fixing. The resultant image was not vanished when rubber strongly with a rubber eraser.

EXAMPLE 38

Seventy parts of styrene resin (Piccolastic D-125, manufactured by ESSO Standard Oil Co.), 15 parts of lead caprylate, and 20 parts of 1,1-bis (p-aminophenyl) phthalan were mixed and ground by a vibrating mill grinder. The said mixture was sufficiently fused and cooled to solidify.

The said solidified material was crushed by a hammer mill crusher, and then ground by a jet mill grinder until the particle size beame 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained by corona-charging and applying a light pattern to a photoconductor composed of selenium vacuum deposited on an alminium plate was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer (a finely divided material) as a color forming agent (B) in water on a high grade paper (50–60 g/m2) until the weight of a dried solid of the said material became to 10 g., was heated at about 180° C. and a portion to which toner image was transferred formed purple color, and as the result, a completely fixed clear copy was obtained. The said image was not vanished at all by strong rubbing with a rubber eraser.

EXAMPLE 39

Employing the process of Example 28, but substituting for Crystal Violet lactone (CVL), each N-(2,5-dichlorophenyl) leuco-auramine, N-acetylauramine, and dianisylidene acetone, there were obtained a similar result to Example 28.

EXAMPLE 40

Employing the process of Example 28, but substituting for styrene resin, each vinyl chloride resin, vinylidene chloride resin, polyethylene, polypropylene. epoxy resin and vinsol resin, the negative chargable toner was produced. There were obtained a result similar to Example 28.

EXAMPLE 41

70 parts of styrene resin (available as a trade name, Piccolastic D-125, from ESSO Standard Oil), 15 parts of glycerine ester of stearic acid (mp. 72° C.), 20 parts of Crystal Violet lactone (CVL) and 5 parts of Erogyl (trade name, silica available from Nippon Erogyl) were mixed and ground by a vibrating mill grinder. The mixture was uniformly melted and cooled to solidify. The solidified material was crushed by a hammer mill crusher, and then ground by a jet mill grinder into the particle size below 5 microns.

100 G. of the formed toner was mixed with 1 l. of Isopar H by an attrator. This concentrated liquid was dispersed in 2 l. of Isopar H to prepare a developing agent.

An electrostatic latent image on an insulating layer, obtained by the process disclosed in Japan Pat. Publication No. 23910/1967 was developed by the developing agent obtained above, to form a toner image. The toner image was transferred to a transferring paper prepared by coating a composition obtained by dispersing 20 weight % of styrene-butadiene copolymer latex as a binder, 0.3 weight % of Dresinate X (trade name, manufactured by Hercules) as an emulsifier, and 79.7 weight % of phenol aldehyde polymer (a finely divided material of about 1–3 microns) as a color forming agent (B) in water on a high grade paper (50–60 g/m2) to form a dried coating of 8 g. per square meter.

The transferred image was heated at about 180° C. to result in a blue clear image on the portion where the toner image was transferred. The resultant image was not vanished when rubbed vigorously with a rubber eraser.

EXAMPLE 42

Seventy parts of styrene resin (Piccolastic D-125, manufactured by ESSO Standard Oil Co.), 15 parts of glycole ester of stearic acid (m.p. 75° C.) and 20 parts of Rhodamine lactam were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e., toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the process disclosed in Japanese Pat. Publication No. 23910/1967 was developed by the above mentioned developing agent by means of magnetic brush technique to form a toner image. The said toner image was transferred to a transferring paper prepared by coating a composition obtained by dispersing 20 weight % of styrene butadien copolymer latex as a binder and 0.3 weight % of Dresinate X (trade mark, manufactured by Hercules Co.) as an emulsifier and 79.7 weight % of phenol acetylene polymer (a finely divided material) as a color forming agent (B) in water on a high grade paper (50–60 g/m$^2$) until the weight of a dried solid of the said material became to 15 g., was heated at about 180° C.and a portion to which the toner image was transferred formed red color, and as the result, a completely fixed clear copy was obtained. The said image was not vanished at all by strong rubbing with a eraser.

EXAMPLE 43

Seventy parts of styrene resin (Piccolastic D-125, manufactured by ESSO Standard Oil Co.), 15 parts of methyl beneate and 20 parts of Malacoite Green lactone were mixed and ground by a vibrating mill grinder. The said mixture was sufficiently fused anc cooled to solidify.

The said solidified material was crushed by a hammer mill crusher, and then ground by a jet mill grinder until the particle size became 1–50 microns, preferably 5–20 microns.

One weight part of the said fine powder (I.e. toner) was mixed with 3–30 weight parts, preferably 5–10 weight parts of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by electrophotography process disclosed in Japanese Pat. Publication No. 23910/1967 was developed by the above mentioned developing agent by means of magnetic brush technique, to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of rosin modified maleic acid polymer (a finely divided material) as a color forming agent (B) in water on a high grade paper (50–60 g/m$^2$) until the weight of a dried solid of the said material became to 10 g., was heated at about 170° C. and a portion to which the toner image was transferred formed green color, and as the result, a completely fixed clear copy was obtained. The said image was not vanished at all by strong rubbing with a rubber eraser.

EXAMPLE 44

70 parts of styrene resin (available as trade name, Piccolastic D-125 from ESSO Standard Oil), 15 parts of ethyl benenate, 20 parts of Crystal Violet lactone (CVL) and 10 parts of Aerosil #200 (trade name, silica available from Nippon Aerosil) were mixed and ground by a vibrating mill grinder.

The mixture was uniformly fused and cooled to solidify.

The solid material was crushed by a hammer mill crusher, and then ground by a jet mill grinder into the toner particle size below 5 micron.

100 G. of the toner was sufficiently ground with 1 l. of Isopar H by an attrator to form a concentrated developing liquid containing toner of 1-2 micron in size. this concentrated liquid was dispersed in 2 l. of Isopar H to prepare a developing agent.

A polyethylene terephthalate film (100 micron thick) undercoated with gelatine was subjected to a conductizing treatment with quaternary ammonium polymer (available as trade name, CP-261, from Calgon Corp.), and sufficiently dried.

A 5% solution of polyvinylcarbazole sensitized with Crystal Violet in monochlorobenzene was additionally applied to the sheet to form a photoconductive coating. Further, to this photoconductive sheet was a 6% solution of chlorinated polyvinylcarbazole 10 parts, styrene maleic anhydride copolymer hydrolyzed product 8 parts in monochlorobenzene applied by a roller to form a coating of 4-6 g/m$^2$. This photoconductive sheet was uniformly charged by corona discharging, and exposed to a light pattern to form an electrostatic latent image, which was developed by the toner. The obtained toner image was heated to result in a blue image with complete fixture. The resultant image could not be vanished when rubbed with a eraser.

EXAMPLE 45

Seventy parts of styrene resin (Piccolastic D-125, manufactured by ESSO Standard Oil Co.), 15 parts of phenyl arachate and, 20 parts of Crystal Violet Lactone (CVL) were mixed and ground by a vibrating mill grinder. The said mixture was sufficiently fused and cooled to solidify.

The said solidified material was crushed by a hammer mill crusher, and then ground by a jet mill grinder until the particle size became 1-50 microns, preferably 5-20 microns.

One weight part of the said fine powder (i.e. toner) was mixed with 3-30 weight parts, preferably 5-10 weight parts, of an iron powder, i.e. carrier.

The particle size of the said carrier is 20-75 microns, preferably 25-50 microns.

The carrier was positively charged and the toner was charged negatively in the mixture of the said carrier and toner, i.e. a developing agent.

Then the electrostatic latent image obtained by corona-charging and applying a light pattern to a photoconductor composed of selenium vacuum deposited on an aluminium plate was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of ethylene-maleic anhydride copolymer hydrolyzed product (a finely divided material) as a color forming agent (B) in water on a high grade paper(50-60 g/m2) until the weight of a dried solid of the said material became to 7 g., was heated at about 180° C. and a portion to which the toner image was transferred formed blue color, and as the result, a completely fixed clear copy was obtained. The said image was not vanished at all by strong rubbing with an eraser.

EXAMPLE 46

70 parts of styrene resin (Piccolastic D-100, available from ESSO Standard Oil Co.), 30 parts of glycol stearate (mp. 75° C) and 20 parts of Crystal Violet lactone (CVL) were mixed and ground in a vibrating mill crusher.The mixture was uniformly melted and cooled into solid.

The solid material was crushed by a hammer mill crusher, and then ground by a jet mill grinder into the particle size of 1-50 microns, preferably, 5-20microns.

One weight part of the said fine powder (i.e. toner) was mixed with 3-30 weight parts, preferably 5-10 weight parts, of an iron powder, i.e. carrier.

The particle size of the said carrier is 20-75 microns, preferably 25-50 microns.

The carrier was positively charged and the toner was charged negatively in the mixture of the said carrier and toner, i.e. a developing agent.

Then the electrostatic latent image was produced on a photoconductive member by uniform corona-charging and applying a light pattern to the photoconductive member composed of selenium vacuum deposited on an aluminium plate.

A solution of carboxy polyethylene polymer hydrolyzed product 5 parts, and polyvinyl butylate 5 parts in 100 parts of methyl ethyl ketone was applied to a base paper undercoated of 3 g/m2 with 2% aqueous solution of sodium alginate, to form a coating of 7 g/m2, The thus produced latent image was transferred to the electrostatic recording paper above produced, and developed by the above developing agent.

The toner image was heated at about 180° C to form blue color. The resultant image was clear with complete fixture. The image could not be vanished at all when rubbed strongly with an eraser.

EXAMPLE 47

Seventy parts of styrene resin (Piccolastic D-125, manufactured by ESSO Standard Oil Co.), 10 parts of glycole stearate (mp. 75° C.) and 20 parts of Rhodamine lactone (available from Hodogaya Chemical Co., Ltd.) were mixed and ground by a vibratng mill grinder. The said mixture was sufficiently fused and cooled to solidify.

The said solidified material was crushed by a hammer mill crusher, and then ground by a jet mill grinder until the particle size became 1-50 microns, preferably 5-20 microns.

One weight part of the said fine powder (i.e. toner) was mixed with 3-30 weight parts, preferably 5-10 weight parts, of an iron powder, i.e. carrier.

The particle size of the said carrier is 20-75 microns, preferably 25-50 microns.

The carrier was positively charged and the toner was charged negatively in the mixture of the said carrier and toner, i.e. a developing agent.

Then the electrostatic latent image obtained by corona-charging and applying a light pattern to a photoconductor layer comprising ZnO-binder was developed by the above mentioned developing agent to form a toner iage. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of vinyl methyl ether - maleic anhydride copolymer hydrolyzed product (a finely divided material of about 1–3 micron in size) as a color forming agent (B) in water on a high grade paper (50–60 g/m2) until the weight of a dried solid of the said material became to 10 g., was heated at about 185° C.and a portion to which the toner image was transferred formed red color, and as the result, a completely fixed clear copy was obtained. The said image was not vanished at all by strong rubbing with an eraser.

EXAMPLE 48

Seventy parts of vinyl chloride-propylene (70 : 30 molar %) copolymer, 20 parts of glycol palmitate and 20 parts of Crystal Violet Lactone (CVL) were mixed and ground by a vibrating mill grinder. The said mixture was sufficiently fused and cooled to solidify.

The said solidified material was crushed by a hammer mill crusher, and then ground a jet mill grinder until the particle size become 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the electrophotography process disclosed in Japanese Patent Publication No. 23910/1967 was developed by the above mentioned developing agent by means of magnetic brush technique to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of phenolacetylene polymer (a finely divided material) as a color forming agent (B) in water on a high grade paper (50–60 g/m2) until the weight of a dried solid of the said material became to 10 g., was heated at about 180° C.and a portion to which the toner image was transferred formed blue color, and as the result, a completely fixed clear copy was obtained. The said image was not vanished at all by strong rubbing with an eraser.

EXAMPLE 49

Seventy parts of styrene resin (Piccolastic D-100, manufactured by ESSO Standard Oil Co.), 15 parts of ethyl arachate and 30 parts of 8′-methoxy indolino spiropyran were mixed and ground by a vibrating mill grinder. The said mixture was sufficiently fused and cooled to solidify.

The said solidified material was crushed by a hammer mill crusher, and then ground a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the electrophotography process disclosed in Japanese Pat. Publication No. 23910/1967 was developed by the above mentioned developing agent by means of magnetic brush technique to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer hydrolyzed product (a finely divided material) as a color forming agent (B) in water on a high grade paper(50–60 g/m2) until the weight of a dried solid of the said material became to 10 g., was heated at about 180° C.and a portion to which the toner image was transferred formed dark blue color, and as the result, a completely fixed clear copy was obtained. The said image was not vanished at all by strong rubbing with an eraser.

EXAMPLE 50

Seventy parts of styrene resin (Piccolastic D-125, manufactured by ESSO Standard Oil Co.), 15 parts of phenyl palmitate and 20 parts of 6,6′-diamino spiro (pathalan 1,9′-xanthene were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the electrophotography process disclosed in Japanese Pat. Publication No. 23910/1967 was developed by the above mentioned developing agent by means of magnetic brush technique to form a toner image. The said toner image was transferred to a transferring paper prepared by coating a composition obtained by dispersing 20 weight % of styrene-butadien copoymer latex as a binder and 0.3 weight % of Dresinate X (trade mark, manufactured by Hercules Co.) as an emulsifier and 79.7 weight % of phenol acetylene polymer (a finely divided material of about 1–3 micron in size) as a color forming agent (B) in water on a high grade paper (50–60 g/m2) until the weight of a dried solid of the said material became to 10 g., was heated at about 195° C.and a portion to which the toner image was transferred formed red color, and as the result, a completely fixed clear copy was obtained. The said image was not vanished at all by strong rubbing with an eraser.

EXAMPLE 51

Seventy parts of styrene resin (Piccolastic D-125, manufactured by ESSO Standard Oil Co.), 15 parts of methyl melissinate and 20 parts of 1,1-bis (p-aminophenyl) phthalan were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained by corona-charging and applying a light pattern to a photoconductor composed of selenium vacuum deposited on an aluminium plate was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer (a finely divided material) as a color forming agent (B) in water on a high grade paper (50–60 g/m2) until the weight of a dried solid of the said material became to 10 g., was heated at about 160° C. and a portion to which the toner image was transferred formed purple color, and as the result, a completely fixed clear copy was obtained. The said image was not vanished at all by strong rubbing with an eraser.

EXAMPLE 52

Employing the process of Example 41, except of using, each, N-(2.5-dichlorophenyl) leuco-auramine, N-acetyl auramine, dianisylidene acetone in place of Crystal Violet lactone (CVL), there were obtained the results similar to Example 41.

EXAMPLE 53

Employing the process of Example 41, except of using each vinyl chloride, vinyldene chloride, polyethylene, polypropylene, epoxy resin, and vinsol resin in place of styrene resin, there was produced the toner negatively chargeable. There was obtained a result similar to Example 41.

EXAMPLE 54

Seventy parts of styrene resin (Piccolastic D-100, manufactured by ESSO Standard Oil Co.), 15 parts of lauric amide 20 parts of Crystal Violet Lactone (CVL) were mixed and ground by a vibrating mill grinder. The said mixture was sufficiently fused and cooled to solidfy.

The said solidified material was crushed by a hammer mill crusher, and then ground a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic laten image obtained on an insulating layer by the electrophotography process disclosed in Japanese Pat. Publication No. 23910/1967 was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of phenol aldelyde polymer (a finely divided material of about 1–3 micron in size) as a color forming agent (B) in water on a high grade paper (50–60 g/m2) until the weight of a dried solid of the said material became to 6 g., was heated at about 205° C and a portion to which the toner image was transferred formed blue color, and as the result, a completely fixed clear copy was obtained. The said image was not vanished at all by strong rubbing with an eraser.

EXAMPLE 55

Seventy parts of styrene resin (Picoolastic D-125, manufactured by ESSO Standard Oil Co.), 15 parts of lauric anilide and 20 parts of Rhodamine lactone were mixed and ground by a vibrating mill grinder. The said mixture was sufficiently fused and cooled to solidify.

The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image obtained on an insulating layer by the electrophotograhy process disclosed in Japanese Pat. Publication No. 23910/1967 was developed by the above mentioned developing agent by means of magnetic brush technique to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of phenol acetylene polymer (a finely divided material) as a color forming agent (B) in water on a high grade paper (50–60 g/m2) until the weight of a dried solid of the said material became to 10 g., was heated at about 180° C. and a portion to which the toner image was transferred formed red color, and as the result, a completely fixed clear copy was obtained. The said image was not vanished at all by strong rubbing with an eraser.

EXAMPLE 56

Seventy parts of styrene resin (Piccolastic D-125, manufactured by ESSO Standard Oil Co.), 15 parts of lauric methyl amide, 20 parts of Malachite Green lactone and 10 parts of Erogyl #200 (trade name, silica available from Nippon Erogyl) were mixed and ground by a vibrating mill grinder. The said mixture was sufficiently fused and cooled to solidify.

The said solidified material was crushed by a hammer mill crusher, and then ground by a jet mill grinder into the toner particle size below 5 microns.

100 G. of the toner was mixed and ground with 1 l of Isopar H by an attritor to prepare a concentrated developing liquid containing the toner of 1–2 microns in size. This liquid 50 ml. was dispersed in 2 l of Isopar H to prepare a developing agent.

To a base paper undercoated with an aqueous 2% solution of sodium alginate at a ratio of 3 g/m$^2$ was a liquid comprising 5 parts of rosin modified maleic acid polymer, 5 parts of polyvinyl butylate and 100 parts of methyl ethyl ketone applied to form a coating of 7 g/m$^2$.

On the obtained electrostatic recording paper was the electrostatic latent image obtained on an insulating layer by the electrophotography process disclosed in Japanese Pat. Publication No. 23910/1967, transferred, and developed by the developing agent produced as above. The afforded toner image was heated to form green color to result in a clear copy with complete fixing. The resultant image was not vanished when rubbed strongly with an eraser.

EXAMPLE 58

Seventy parts of styrene resin (Piccolastic D-125, manufactured by Esso Standard Oil Co.), 15 parts of stearic acid amide, 20 parts of Crystal Violet Lactone (CVL), and 10 parts of Erogyl #200 (Silica powder, manufactured by Nippon Erogyl Co.) were mixed and ground by a vibrating mill grinder. The resulting mixture was sufficiently fused and cooled to solidify. The solidified material was crushed by a hammer mill crusher and then ground by a jet mill grinder until a particle size became less than 5 microns to form a toner. The concentrated developing liquid containing a toner of 1–2 microns of the particle size was produced by mixing sufficiently 100 g. of the toner and 1 liter of Isopar H, a developing liquid was prepared by dispersing 50 ml. of the concentrated developing liquid in 2 liter of Isopar H.

Then, the electrostatic latent image obtained by corona-charging and applying a light pattern to a photoconductor composed of selenium vacuum deposited on an aluminium plate was developed by the above mentioned developing agent to form a toner image. The toner image was transferred to a transferring paper prepared by coating a composition obtained by dispersing 20 weight % of styrene-butadienecopolymer latex as a binder and 0.3 weight % of Dresinate X (trade mark manufactured by Hercules Co.) as an emulsifier and 79.7 weight % of the hydrolyzed product of ethylene-maleic anhydride copolymer (finely divided material) as a color forming agent (B) in water on a high grade paper (50–60 g/m2) until the weight of a dried solid of the said material became 10 g/m2, and was heated at about 200 deg. C., and the portion to which the toner image was transferred formed blue color, and as the result a completely fixed clear copy was obtained.

EXAMPLE 59

Seventy parts of styrene resin (Piccolastic D-100, manufactured by Esso Standard Oil Co.), 30 parts of Crystal Violet Lactone (CVL) were mixed and ground by a vibrating mill grinder. The said mixture was sufficiently fused and cooled to solidify. The said solidified material was crushed by a hammer mill crusher, and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder i.e. carries.

The particle size of the said carrier is 20–75 microns, preferably 25–50 microns.

The carrier was positively charged and the toner was charged negatively in the mixture of the said carrier and toner, i.e. a developing agent.

Then, the electrostatic latent image obtained by corona-charging and applying a light pattern to a photoconductor composed of selenium vacuum deposited on an aluminium plate was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer (a finely divided material) as a color forming agent (B) in water on a high grade paper (50–60 g/m2) until the weight of a dried solid of the said material became to 10 g/m2, was heated at about 190 deg. C and a portion to which the toner image was transferred formed blue color, and as the result, a completely fixed clear copy was obtained. The image was not vanished at all by strong rubbing.

EXAMPLE 60

Seventy parts of styrene resin (Piccolastic D-125, manufactured by Esso Standard Oil Co.), 70 parts of caprylicmethyl amide (m.p. 57 deg. C) and 20 parts of Rhodamine Lactone (RL, manufactured by Hodogaya Kagaku Co.) were mixed and ground by a vibrating mill grinder. The said mixture was sufficiently fused and cooled to solidify. The said solidified material was crushed by a hammer mill crusher, and then ground by a jet mill grinder until the particle size became 1–50 microns, preferably 5–20 microns.

One weight part of said fine powder (i.e. toner) ws mixed with 3–30 weight parts, preferably 5–10 weight parts, of an iron powder, i.e. carrier.

The particle size of said carrier is 20–75 microns, preferably 25–50 microns.

The carrier was positively charged and the toner was charged negatively in the mixture of the said carrier and toner, i.e. a developing agent.

Then the electrostatic latent image obtained by corona-charging and applying a light pattern to a photoconductor of ZnO-binder system was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of the hydrolyzed product of vinyl methyl ether-moleic anhydride (a finely divided material, particle size 1–8 microns) as a color forming agent (B) in water on a high grade paper (50–60 g/m2) until the weight of a dried solid of the said material became to 10 g., was heated at about 180 deg. C.and a portion to which the toner image was transferred formed red color, and as the result, a completely fixed clear copy was obtained. The said image was not vanished at all by strong rubbing.

EXAMPLE 61

Seventy parts of vinyl chloride-propylene copolymer (70:30 mol %), 70 parts of palmitic amide, and 20 parts of Crystal Violet Lactone (CVL) were mixed and ground by a vibrating mill grinder. The said mixer was sufficiently fused and cooled to solidify. The solidified material was crushed by a hammer mill crusher, and then ground by a jet mill grinder until the particle size became 1–50 microns, preferably 5–20 microns.

One weight part of the said fine powder (i.e. toner) ws mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. developing agent.

Then the electrostatic latent image on an insulating layer obtained by an electrophtographic process mentioned in Japanese Pat. Publication No. 23910/1967 was developed by the above mentioned developing agent and a magnetic brushing technic to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of phenol acetylene polymer (a finely divided material) as a color forming agent (B) in water on a high grade paper (50–60 g/m$^2$) until the weight of a dried solid of the said material became to 10 g., was heated at about 180 deg. C. and a portion to which the toner image was transferred formed violet color, and as the result, a completely fixed clear copy was obtained. The said image was not vanished at all by strong rubbing.

EXAMPLE 62

Seventy parts of styrene resin (Piccolastic D-125), 15 parts of behenic amide, and 30 parts of 8′-methoxy indolins spiropyrane were mixed and ground by a vibrating mill grinder. The said mixture was sufficiently fused and cooled to solidify. The said solidified material was crushed by a hammer mill crusher and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the carrier and the toner, i.e. a developing agent.

Then the electrostatic latent image on an insulating layer obtained by an electrophotography process mentioned in Japanese Pat. Publication No. 28910/1967 was developed by the above mentioned developing agent and a magnetic brushing technic to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of the hydrolyzed product of carboxy polyethylene polymer (a finely divided material) as a color forming agent (B) in water on a high grade paper (50–60 g/m$^2$) until the weight of a dried solid of the said material became to 10 g., was heated at about 180 deg. C and a portion to which the toner image was transferred formed bluish black color, and as the result, a completely fixed clear copy was obtained.

EXAMPLE 63

Seventy parts of styrene resin (Piccolastic D-125), 15 parts of palmitic anilide, and 20 parts of 6.6′-diamins spiro (phthalan 1.9′-Xanthene) were mixed and ground by a vibrating mill grinder. The said mixture was sufficiently fused and cooled to solidify. The said solidified material was crushed by a hammer mill crusher, and then ground by a jet mill grinder until the particle size became 1–50 microns, preferably 5–20 microns.

One weight part of the fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier was positively charged and the toner was charged negatively in the mixture of the said carrier and toner, i.e. a developing agent.

Then the electrostatic latent image on an insulating layer obtined by an electrophotography process mentioned in Japanese Pat. Publication No. 23910/1967 was developed by the above mentioned developing agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of phenol acetylene polymer (a finely divided material, particle size 1–8 microns) as a color forming agent (B) in water on a high grade paper (50–60 g/m$^2$) until the weight of a dried solid of the said material became to 10 g., was heated at about 195 deg. C and a portion to which the toner image was transferred formed red color, and as the result, a completely fixed clear copy was obtained. The said image was not vanished at all by strong rubbing.

EXAMPLE 64

Seventy parts of styrene resin (Piccolastic D-125), 15 parts of caprylic anilide, and 20 parts of 1.1 bis (P-aminophenyl) phthalan were mixed and ground by a vibrating mill grinder. The said mixture was sufficiently fused and cooled to solidify. The said solidified material was crushed by a hammer mill crusher and then ground by a jet mill grinder until the particle size became 1–50 microns, preferably 5–20 microns.

One weight part of the said fine powder (i.e. toner) was mixed with 3–30 weight parts, preferably 5–10 weight parts, of an iron powder, i.e. carrier.

The particle size of the said carrier is 20–75 microns, preferably 25–50 microns.

The carrier ws positively charged and the toner was charged negatively in the mixture of the said carrier and toner, i.e. a developing agent.

Then the electrostatic latent image obtained by corona-charging and applying a light pattern to a photoconductor composed of selenium vacuum deposited on an aluminium plate was developed by the above mentioned deveoping agent to form a toner image. The said toner image was transferred to a transferring paper prepared by coating a composition obtained by dispersing 20 weight % of styrene-butadien copolymer latex as a binder and 0.3 weight % of Dresinate X (trade mark, manufactured by Hercules Co.) as an emulsifier and 79.7 weight % of carboxy polyethylene polymer (a finely divided material) as a color forming agent (B) in water on a high grade paper (50–60 g/m2) until the weight of a dried solid of the said material became 10 g., was heated at about 160 deg. C and a portion to which the toner image was transferred formed violet color, and as the result, a completely fixed clear copy was obtained. The said image was not vanished at all by strong rubbing.

EXAMPLE 65

N-(2.5-dichlorophenyl) lenco auramine, N-acetyl auramine or dianisylidene acetone was used in place of crystal violet in EXAMPLE 54, and the other procedures were the same as those of EXAMPLE 54. The result was the same as that of EXAMPLE 54.

EXAMPLE 66

Vinyl chloride resin, vinylidene chloride resin, polyethylene-polypropylene-epoxy resin or vinsol resin was used in place of styrene resin in EXAMPLE 54 and the other procedures were the same as those of EXAMPLE 54. As the result, negatively charged toner was obtained and other results were the same as those of EXAMPLE 54.

EXAMPLE 67

Fifty parts of phenol aldehyde polymer, 30 parts of stearic acid, 20 parts of styrene-butadiene latex (film forming agent), 150 parts of water and 0.4 parts of Dresinate X (emulsifier) were mixed and ground by a ballmill grinder for more than ten hours. A paper was coated with the resulting emulsion until the weight of a dried solid of the said emulsion became 10 g/m2, and was dried. The coated paper was cut in a suitable size and was used as a transferring sheet.

Fourty parts of 8'-methoxyindolino spiropyrane and 60 parts of styrene resin (Piccolastic D-125, manufactured by Esso Standard Oil Co.) was fused and cooled to solidify. The said solidified material ws ground until the particle size became 1–30 microns, preferably 5–15 microns.

One part of the said fine powder (i.e. a toner) was mixed with iron powders of 3–30 parts, preferably 5–10 parts.

The particle size of a carrier was 20–75 microns, perferably 25–50 microns.

The carrier was positively charged and the toner was negatively charged in the developing agent which was the mixture of the carrier and the toner.

After the above mentioned developing agent was put in the magnetic brushing type developer, the toner image was transferred to a transferring sheet by the electrophotographic copying machine (NP-100, manufactured by Canon Co.) using the electrographic process mentioned in Japanese Pat. Publication No. 23910/1967, and color forming and fixing of the said toner image were held by the fixing machine shown in FIG. 3. The clear bluish black color copy was obtained at about 180 deg. C. This image was not vanished at all by strong rubbing.

EXAMPLE 68

The transferring sheet was produced by the same process as that of EXAMPLE 67 except adding phenolacetylene polymer (a color forming agent B) and 25 parts of myristic acid (a color forming auxiliary agent).

The toner was produced by treating 40 parts of Crystal Violet Lactone (CVL) and 60 parts of P-cyanostyrene-styrene polymer (cyanostyrene 4.3%, styrene 95.7%) (manufactured by Denki Kagaku Kogyo Co.) by the same process as that of EXAMPLE 67 and was arranged as a developing agent.

the carrier was positively charged and the toner was negatively charged in the developing agent of the carrier and the toner.

After the developing agent was put in the magnetic brushing type developer, the toner image was formed on the drum having a photosensitive layer by Canon NP process and was transferred to the transferring sheet. Color forming and fixing were held by the fixing machine, and a clear blue copy was obtained at about 160 deg. C.

EXAMPLE 69

The transferring sheet was produced by the same process as that of EXAMPLE 67 except adding 50 parts of rosin modified maleic acid (color forming agent B) and dibenzoic acid ethylene glycol (color forming auxiliary agent).

The toner was produced by treating 40 parts of Rhodamine Lactone (RL) and 60 parts of polyester resin (XPL 2005, manufactured by Kao Atlas Co.), by the same process as that of EXAMPLE 67.

The carrier was negativey charged and the toner was positively charged in the developing agent of the carrier and the toner.

After the above mentioned developing agent was put in the magnetic brushing type developing machine, as electrostatic latent image produced by applying negative electric charge to the surface of the drum having photoconductive ZnO and exposing through an original was developed by the above mentioned developing machine to form a toner image. The resulting toner image was transferred to the above mentioned transferring sheet. Color forming and fixing of the toner image was held by the above mentioned fixing machine. A clear red copy was obtained at about 190 deg. C.

EXAMPLE 70

The transferring sheet was produced by the same process as that of EXAMPLE 67 except adding parts of hydrolyzed product of styrene-maleic anhydride copolymer (color forming agent B) and 25 parts of diphenyl phthalate (color forming auxiliary agent).

The toner was produced by treating Leuco auramine (LA) in the same way as in EXAMPLE 67.

The carrier was negatively charged and the toner was postively charged in the developing agent of the carrier and the toner.

after the above mentioned developing agent was put in the magnetic brushing type developing machine, the electrostatic latent image formed by applying negative electric charge to the surface of the drum having photoconductive ZnO and by exposing through an original was developed by the above mentioned dveloping machine to form the toner image. The resulting toner image was transferred to the above described transferring sheet. Color forming and fixing was held by the above decribed fixing machine. A clear yellow copy was obtained at about 190 deg. C.

EXAMPLE 71

A transferring sheet was produced by the same process as in EXAMPLE 67 except adding 50 parts of phenol-aldehyde polymer (color forming agent B) and 25 parts of lacceric acid (color forming auxiliary agent).

The toner was produced by ehs ame process as in EXAMPLE 67 except using 40 parts of CVL and 60 parts of vinyl chloride resin (trade name, Denka Vinyl, manufactured by Denki Kaguku Kogyo Co.) as a dveloping agent.

The carrier was positively charged and the toner was negatively charged in the developing agent.

After the above mentioned developing agent was put in the magnetic brushing type developing machine, the electrostatic latent image was developed by Canon NP process on the surface of the photosensitive layer and then a toner image was transferred to the above described transferring sheet. Color forming and fixing of the toner image was held by the above described fixing machine, and a clear blue copy was obtained at about 200 deg. C.

EXAMPLE 72

A toner was produced by fusing 40 parts of 8'-methoxyindolino spiropyrane and 60 parts of polystyrene (Piccolastic D-125), cooling and then grinding by a jet mill grinder until the particle size became 5–20 microns.

One part of the toner was mixed with 3–30 parts, preferably 5–10 parts of iron powder i.e. a carrier. The particle size of the carrier was 20–75 microns, preferably 25–50 microns.

The carrier was positively charged and the toner was negatively charged in the developing agent.

The electrostatic latent image formed on the insulated layer by the electrography process mentioned in Japanese Pat. publication No. 23910/1967 was developed by the above mentioned developing agent and the magnetic brushing technic to form a toner image.

Then, 50 parts of phenol aldehyde polymer, 30 parts of aluminum stearate, 150 parts of water, and 0.4 part of emulsifier (Daesinate X, manufactured by Hercules Co.) were mixed and ground by a ball mill for 24 hours. The toner image was transferred to a transferring paper which was coated with the emulsion until the weight of a dried solid of the emulsion became 10 g./m$^2$, and was heated at about 180 deg. C. A portion to which the toner image was transferred formed bluish black color, and as the result, a completely fixed clear copy was obtained. The image was not vanished at all even by strong rubbing.

EXAMPLE 73

Fourty parts of Crystal Violet Lactone and 60 parts of p-cyanostyrene-styrene (P-cyanostyrene 4.8%, styrene 97.7%) were fused and cooled to solidify. The solidified material was ground by a jet mill grinder until the particle size became 5–20 microns.

One part of the said fine powder (i.e. a toner) and 3–30 parts, preferably 5–10 parts of iron powder (i.e. a carrier) were mixed.

Then the electrostatic latent image formed on an insulting layer by the electrophotographic process mentioned in Japanese Pat. Publication No. 23910/1967 was developed by the dveloping agent and a magnetic brushing technic and a toner image was formed. Further, 50 parts of phenol acetylene polymer, 25 parts of lead capronate, 20 parts of styrene-butadiene latex, 150 parts of water and 0.4 part of an emulsifier (trade name, Dresinate X, manufactured by Hercules Co.) were mixed by a ball mill for 24 hours. The toner image was transferred to a transferring paper which was coated with the said emulsion until the weight of the dried solid of the emulsion became 10 g./m$^2$, and was heated to about 160 deg. C. A portion to which the toner image was transferred formed blue color, and as the result, a clear copy was obtained. The image was not vanished at all by strong rubbing.

EXAMPLE 74

Fourty parts of Rhodamine Lactone and 60 parts of Polyester resin (XPL 2005, manufactured by Kao Atlas Co.) were fused and cooled to solidify. The solidified material was ground by a jet mill grinder until the particle size became 5–20 microns.

One part of the fine powder (i.e. toner) and 3–30 parts, preferably 5–10 parts of iron powder (i.e. carrier) were mixed.

After the said developing agent was put in the magnetic brushing type developing machine, the electrostatic latent image formed by applying negative electric charge on the drum having photoconductive ZnO and by exposing through an original was developed by the dveloping machine to form the toner image.

Then, 50 parts of resin modified maleic acid, 25 parts of mono glycerol stearate, 20 parts of styrene-butadiene latex, 150 parts of water, and 0.4 parts of emulsifier (Dresinate X) were mixed and ground by a ball mill for 24 hours.

The said toner image was transferred to the transferring paper which was coated with the said emulsion until the weight of the dried solid became 10 g./m$^2$, and was heated to 160 deg. C. As the result, a portion to which the toner image was transferred formed red color and a clear copy was obtained. The image was not vanished at all by strong rubbing.

EXAMPLE 75

Fourty parts of Leuco auramine and 60 parts of polystyrene (Piccolastic D-100) were fused and cooled to solidify. The solidified material was ground by a jet mill grinder until the particle size became 5–20 microns.

One part of the fine powder (i.e. a toner) was mixed with 3–30 parts, preferably 5–10 parts of iron powder (i.e. carrier).

Then the electrostatic latent image formed in an insuating layer by the electrogrpaphic process mentioned in Japanese Pat. Publication No. 23910/1967 was developed by the said devloping agent and magnetic brushing technic to form the toner image. Further, 50 parts of hydrolyzed product of styrene-maleic anhydride copolymer, 25 parts of methyl behenate, 20 parts of styrene-butadiene latex, 150 parts of water and 0.4 part of an emulsifier (Dresenate X) were mixed and ground by a ball mill for 24 hours. The toner image was transferred to the transferring paper which was coated with the emulsion at an amount of 10 g./m$^2$ (as solid), and heated to about 170 deg. C. As the result, a portion to which the toner image was transferred foremd yellow color, and a clear copy was obtained. The resulting image was not vanished at all by strong rubbing.

EXAMPLE 76

Fourty parts of 6.6'-diaminospiro (phthalan-1.9'-xanthene) and 60 parts of polyester resin were fused and cooled to solidify. The solidified material was ground by a jet mill until the particle size became 5-20 microns to form a toner.

Then 1.0 part of acrylic resin, 4 part of ZnO, 2 part of hydrolyzed product of carboxy polyethylene polymer and mixed solvent of xylene and toluene (50:50) were mixed and dispersed by a ball mill for 24 hours, and furthermore the solvent was added until the viscosity of the solution became 80-100 cp. The paper of ZnO-acrylic resin system was coated with the soltuion at an amount of 4-5 g./m$^2$.

The electrostatic latent image obtained by corona-charging and applying a light pattern to a photoconductor of ZnO-binder system was developed by the toner to form a toner image. The toner image was fixed at 200 deg. C., and formed red color to obtain a clear copy.

EXAMPLE 77

Fourty of 1.1-bis (aminophenyl phthalan) and 60 parts of epoxy resin were fused and cooled to solidify. The solidified material was ground by a jet mill until the particle size became 5-20 microns.

One part of the fine powder (i.e. a toner) and 3-30 parts, preferably 5-10 parts of iron powder (i.e. a carrier) were mixed.

Then the electrostatic latent image formed on an insultaing layer by the electrostatic process mentioned in Japanese Pat. Publication No. 23910/1967 was developed by the said developing agent and the magnetic brushing technic to form a toner image.

Fifty parts of hydrolyzed product of vinyl methyl ether-maleic anhydride copolymer 25 parts of myristic acid anilide, 20 parts of styrene-butadiene (Dow 636, film forming agent), 150 parts of water and 0.4 parts of an emulsifier (Dresinate X) were mixed and ground by a ball mill for 24 hours. The toner image was transferred to the transferring paper which was coated with the emulsion at an amount of 10 g./m$^2$ (as solid) and was heated to about 180 deg. C., and as the result, a portion to which the toner image was transferred formed red color to obtain a clear copy. The resulting image was not vanished at all by strong rubbing.

EXAMPLE 78

| | |
|---|---|
| Malachite Creen Lactam | 40 parts by weight |
| Polystyrene (trade name, riccolastic B-125 | 60 parts by weight |

A mixture of the above components were melted and cooled to solidify. The resulting solid matter was crushed by a hammer mill crusher and then ground by a jet mill grinder until the particle size became 1 - 50 microns, preferred with 5 - 20 microns. One part by weight of the resulting fine powder, i.e. toner, was mixed with 3 - 30 parts by weight, preferred with 5 - 10 parts by weight, of iron powder, i.e. carrier. Particle size of the carrier was 20 - 75 microns, preferred with 25 - 50 microns.

A photoconductive member composed of an aluminum plate having a vapor-deposited selenium was uniformly corona-charged and exposed to a light pattern to obtain an electrostatic latent image, followed by developing with the above mentioned developer to form a toner image.

50 Parts by weight of hydrolyzed product of ethylene-maleic anhydride copolymer, 25 parts by weight of lauric methylamide, 20 parts by weight of styrene-butadiene latex (film shaping agent), 150 parts by weight of water and 0.4 parts by weight of emulsifier (trade mark, Dresinate X) were mixed and ground by a ball mill for 24 hours. The resulting emulsion liquid was coated on a paper at an amount of 10 g./m$^2$, to form a transferring paper. The toner image as obtained above was transferred to the transferring paper and heated at about 170° C.to form a sharp green copy at the portion to which the toner image was transferred. The resulting colored image was not vanished at all by rubbing.

EXAMPLE 79

| | |
|---|---|
| N-(2,5-dichlorophenyl) leuco auramine | 40 parts by weight |
| Polystyrene | 60 parts by weight |

The mixture of the above two components was mixed, melted, cooled, and crushed by a jet mill crusher to a particle size of 5 - 20 microns to form a toner.

One part by weight of the resulting fine powder toner was mixed with 3 - 30 parts by weight, preferred 5 - 10 parts by weight of iron powder carrier.

An electrostatic latent image on an insulating layer produced by an electrophotographic method of Japanese Pat. Publication No. 23910/1967 was developed with a developer by a magnetic brush method.

Diatomaceous earth 50 parts by weight, stearic dodecylamide 25 parts by weight, styrene-butadiene latex (film forming agent) 30 parts by weight, water 150 parts by weight, and emulsifier (trade name, Dresinate X) 0.4 parts by weight were mixed and ground for 24 hours by a ball mill. The resulting emulsion liquid was coated on a paper at an amount of 10 g./m.$^2$ (as solid) to form a transferring paper, and the toner image obtained above was transferred thereto and heated at about 200° C.to produce a colored image at a portion to which the toner image was transferred. The resulting colored image was not vanished when rubbed strongly with a eraser.

EXAMPLE 80

| | |
|---|---|
| N-Acetyl auramine | 40 parts by weight |
| Vinyl chloride-propylene copolymer (70:70 mole %) | 60 parts by weight |

The above components were mixed, melted, cooled and crushed by a jet mill crusher to a particle size of 5 - 20 microns to produce a toner.

One part by weight of the resulting fine powder toner was mixed with 3 - 30 parts by weight, preferred with 5 - 10 parts by weight of iron powder carrier.

An electrostatic latent image on an insulating layer produced by an electrophotographic method of Japanene Pat. Publication No. 23910/1967 was developed with a developer by a magnetic brush method to form a toner image.

Japanese acid clay 50 parts by weight, glycol palmitate 25 parts by weight, styrene-butadiene latex 20 parts by weight, water 150 parts by weight and an emulsifier (trade name, Dresinate, supplied by Hercules Co.) 0.4 parts by weight were mixed and ground for 24 hours by a ball mill. The resulting emulsion liquid was coated on a paper at an amount of 10 g./m.$^2$ (as solid) to produce a transferring paper. The toner image as obtained above was transferred to this transferring paper and heated at 200° C.to produce a bluish black color image at a portion to which the toner image was transferred. This colored image was not vanished at all even when rubbed with an eraser.

EXAMPLE 81

| | |
|---|---|
| Crystal Violet Lactone | 20 parts by weight |
| Polystyrene (trade name, Piccolastic D-70) | 80 parts by weight |
| Stearic acid | 10 parts by weight |
| Silica powder (trade name, Erogyl 200, supplied by Nihon Erogyl) | 10 parts by weight |

The above mentioned components were mixed, melted, cooled and ground to a particle size of less than 5 microns by a jet mill crusher to produce a toner.

100 G. of the resulting fine powder toner was added to 1 l of Isopar H and crushed to a particle size of 1 - 2 microns by an attritor. 50 Ml. of this concentrated liquid was dispersed in 2 l of Isopar H to form a liquid developer.

An electrostatic latent image on an insulating layer obtained by an electrophotographic method of Japanese Pat. Publication No. 23910/1967 was developed with the liquid developer as produced above to form a toner image.

Phenol aldehyde polymer 50 parts by weight, phenyl palmitate 25 parts by weight, styrene-butadiene latex (film forming agent) 20 parts by weight, water 150 parts by weight, and an emulsifier (trade name, Dresinate X) 0.4 part by weight were mixed and ground for 24 hours by a ball mill. The resulting suspension liquid was coated on a paper at an amount of 10 g./m.$^2$ (as solid) to form a transferring paper, to which the toner image as obtained above was transferred followed by heating at about 180° C. to form a sharp blue color image at a portion to which the toner image was transferred. The resulting colored image was not vanished at all when rubbed with an eraser.

EXAMPLE 82

Styrene resin (trade name, Piccolastic D-125, supplied by Esso Standard Petroleum) 70 parts, stearic acid glycerine ester (m.p. 72°C.) 15 parts and Crystal Violet Lactone (CVL) 20 parts were mixed and ground by a vibrating mill grinder. The resulting mixture was sufficiently melted, and cooled to solidify. The resulting solid matter was crushed by a hammer mill crusher and then pulverized by a jet mill grinder to a particle size of 1 - 50 microns, preferred with 5 - 20 microns.

One part by weight of the resulting fine powder, i.e. toner, was mixed with 3 - 30 parts by weight, preferred with 5 - 10 parts by weight, of iron powder, i.e. carrier. Particle size of the carrier is 20 - 75 microns, preferred with 25 - 50 microns.

Then, an electrostatic latent image on an insulating layer obtained by an electrophotographic method of Japanese Pat. Publication No. 23910/1967 was developed with a developer as obtained above by a magnetic brush method to produce a toner image. The resulting toner image was transferred to a transferring paper obtained by coating a high grade paper (50 - 60 g./m.$^2$) with a mixture of styrene-butadiene copolymer latex as binder 20% by weight, Dresinate X (trade name, supplied by Hercules Co.) as emulsifier 0.3% by weight, and phenol-aldehyde polymer (finely divided particle of 1 - 3 microns in size) as color forming agent B 79.7% by weight, dispersed in water at an amount of 10 g.m.$^2$ (as solid), and heated at 180° C. to produce a completely fixed sharp blue image. The resulting colored image was not vanished at all by rubbing with an eraser.

EXAMPLES 83 - 121

Seventy parts of a binder resin, 15 parts of a color forming auxiliary agent and 20 parts of a color forming agent as shown in Table 19 were mixed and ground by a vibrating mill grinder.

The resulting mixture was sufficiently melted and cooled to solidify. The resulting solid matter was crushed by a hammer mill crusher and then finely divided by a jet mill grinder to a particle size of 1 - 50 microns, preferred with 5 - 20 microns. The resulting finely divided powder, i.e. toner, was mixed with 3 - 30 parts by weight, preferred with 5 - 10 parts by weight, or iron powder, i.e. carrier which particle size was 20 - 75 microns, preferred with 25 - 50 microns.

Then, an electrostatic latent image on an insulating layer produced by an electrophotographic method of Japanese Pat. Publication No. 23910/1967 was developed with the toner obtained above by a magnetic brush method to form a toner image. The resulting toner was transferred to a transferring paper produced by coating a high grade paper (50 - 60 g./m.$^2$) with styrene-butadiene copolymer latex as binder 20% by weight, Dresinate X (trade name, supplied by Hercules Co.) as emulsifier 0.3% by weight, a color forming agent (B) selected from Table 20 (finely divided matter) 79.7% by weight dispersed in water at an amount of 10 g./m.$^2$ (as solid), and then heated at about 170 - 180° C.to produce a completely fixed sharp image. The resulting image was not vanished at all when rubbed strongly with an eraser.

Table 19

| Example No. | Binder resin | Color forming auxiliary agent | Color forming agent | Transferring paper |
|---|---|---|---|---|
| 83 | Epoxy resin | Stearic acid | Malachite Green | 1 |
| 84 | Vinsol resin | " | " | 1 |
| 85 | Polyvinyl chloride resin | " | " | 1 |
| 86 | Polypropylene resin | " | " | 1 |
| 87 | Polyethylene resin | " | " | 1 |
| 88 | Styrene-metayl acrylate copolymer | " | " | 1 |
| 89 | Vinyl chloride-vinyl acetate copolymer | " | " | 1 |
| 90 | Epoxy resin | Myristic acid | Crystal Violet lactone | 2 |
| 91 | " | " | Malachite Green lactam | 2 |
| 92 | " | " | 8'-Methoxyincolino- | 2 |

Table 19-continued

| Example No. | Binder resin | Color forming auxiliary agent | Color forming agent | Transferring paper |
|---|---|---|---|---|
| | | | spiropyrane | |
| 93 | " | " | Rhodamine lactam | 2 |
| 94 | " | " | 6,6'-diaminospiro (phthalan 1,9'-xasthene) | 2 |
| 95 | " | " | 1,1-bis(g-amino-phenyl) phthalan | 2 |
| 96 | " | " | N-(2,5-dichlorophenyl) leuco auramine | 2 |
| 97 | " | " | N-acetylauramine | 2 |
| 98 | " | " | Dianisylidene acetone | 2 |
| 99 | Polyvinyl chloride resin | Behenic acid | Crystal Violet lactone | 3 |
| 100 | " | Lacceric acid | " | 3 |
| 101 | " | Methyl behenate | " | 3 |
| 102 | Polyvinyl chloride resin | Methyl melissinate | Crystal Violet lactone | 3 |
| 103 | " | Ethyl lignocerate | " | 3 |
| 104 | " | Phenyl palmitate | " | 3 |
| 105 | " | Glycol myristate | " | 3 |
| 106 | " | Glycol stearate | " | 3 |
| 107 | Vinyl chloride resin | Glycerol laurate | " | 3 |
| 108 | " | Glycerol stearate | " | 3 |
| 109 | " | " | Malachite Green lactone | 4 |
| 110 | " | Propionic acid amide | " | 4 |
| 111 | " | Palmitic acid amide | " | 4 |
| 112 | " | Caprylic acid anilide | " | 4 |
| 113 | " | Behenic acid amide | " | 4 |
| 114 | " | Myristic acid methylamide | " | 4 |
| 115 | " | Stearic acid dodecylamide | " | 4 |
| 116 | Styrene resin | Glycerol stearate | Crystal violet lactone | 5 |
| 117 | " | " | " | 6 |
| 118 | " | " | " | 7 |
| 119 | " | " | " | 8 |
| 120 | " | " | " | 9 |
| 121 | " | " | " | 10 |

Table 20

| Transferring Iember No. | Color forming agent |
|---|---|
| 1 | Thenol-aldehyde polymer |
| 2 | Phenol-acctylene polymer |
| 3 | Rosin modified maleic resin |
| 4 | Hydrolyzed product of styrene-maleic anhydride copolymer |
| 5 | Hydrolyzed product of ethylene-maleic anhydride copolymer |
| 6 | Hydrolyzed product of carboxy polyethylene polymer |
| 7 | Vinyl methyl ether-maleic anhydride copolymer |
| 8 | Japanese acid clay |
| 9 | Bentonite |
| 10 | Phenol-aldehyde copolymer + Japanese acid clay (1 : 1) |

EXAMPLE 122

Styrene resin (trade name, Piccolastic D-125, supplied by ESSO Standard Oil, softening point 90–125°C.) 70 parts, Glycol stearate (mp. 75°C.) 30 parts, and Crystal Violet Lactone (CVL) 20 parts were mixed and crushed by a vibrating mill crusher. The resulting mixture was then sufficiently melted and cooled to solidify.

The resulting solid matter was crushed by a hammer mill crusher and then by a jet mill grinder to form a toner of a particle size of less than 5 microns, and 100 g. of the resulting toner was sufficiently ground together with 1 l. of Isopar H by an attritor to form a concentrated liquid developer containing a toner of 1–2 microns in particle size. 50 Ml. of the resulting concentrated liquid was dispersed in 2 l. of Isopar H to form a liquid developer.

A quarternary ammonium salt polymer (trade name, CP-261, supplied by Calgon Corp.) was applied onto a polyethylene terephthalate film (100 microns thick) having a gelatine undercoating to impart electroconductivity and then dried sufficiently. Further, a 5% solution of cyanated polyvinylcarbozole sensitized by Crystal Violet was coated on the film obtained as above by using a roll to form a photoconductive film.

On the resulting photoconductive film was coated a 6% solution of cyanated polyvinylcarbazole 10 parts and a hydrolyzed product of ethylene-maleic anhydride copolymer 8 parts in monochlorobenzene in the thickness of 4–6 g./m.2 by a roll.

The resulting photoconductive film was subjected to a uniform corona charging, exposed to a light pattern to for an electrostatic latent image, developed with the toner as obtained above, and heated to form a completely fixed blue color image.

EXAMPLE 123

70 Parts of vinyl chloride - vinyl acetate (91 : 9 mole %) copolymer resin, 10 parts of glycol stearate and 20 parts of Crystal Violet Lactone (CVL) were mixed and crushed by a vibrating mill grinder. The resulting mixture was sufficiently mixed, melted and cooled to solidify.

The resulting solid matter was crushed by a hammer mill and then by a jet mill grinder to a particle size of 1–50 microns, preferred with 5–20 microns. One part of the resulting finely divided toner was mixed with 3–30 parts by weight, preferred with 5–10 parts by weight, of iron powder, i.e. carrier. Particle size of the carrier was 20–75 microns, preferred 25–50 microns.

A photoconductive layer of ZnO - binder system was uniformly corona-charged, exposed to a light pattern and developed to form a toner image. The resulting toner was transferred to a transferring paper produced by coating a high grade paper (50–60 g.m.$^2$) with styrene-butadiene copolymer latex as binder 20% by weight, Dresinate X (trade name, supplied by Hercules Co.) as emulsifier 0.3% by weight, a hydrolyzed product of vinyl methyl ether - maleic anhydride (finely divided) as color forming agent (B) 79.7% by weight dispersed in water at an amount of 10 g./m2 (as solid), and then heated at about 180° C. to produce a completely fixed sharp blue image. The resulting image was not vanished at all when rubbed strongly with an eraser.

EXAMPLE 124

OPBA (Formula 1) 50 parts, stearic acid 30 parts, styrene - butadiene latex 20 parts, water 150 parts, and Dresinate X (trade name, supplied by Hercules Co., an emulsifier) 0.4 parts were mixed and ground for about 10 hours by a bail mill grinder. The resulting emulsion liquid was coated on a paper at an amount of 10 g./m$^2$ (as solid), dried by heating and cut to an appropriate size. The resulting paper was used as an image receiving sheet.

8'-Methoxyindolinospiropyrane 40 parts and styrene resin (trade name, Piccolastic D-125, supplied by ESSO Standard Oil) 60 parts, were mixed, melted, cooled to solidify and finally divided. The particle size distribution was 1–30 microns, preferred with 5–15 microns. One part of the resulting toner was mixed with 3–30 parts by weight, preferred with 5–10 parts by weight, of iron powder, i.e. carrier. The particle size of carrier was 20–75 microns, preferred with 25–50 microns.

In developer comprising the carrier and the toner, the carrier was positively charged and the toner was negatively charged.

The resulting developer was placed in a developing device of magnetic brush type. According to an electrophotographic process of Japanese Pat. Publication No. 23910/1967, a toner image was formed by using an electrophotographic copying machine (trade name, NP-1100, manufactured by Canon K.K.) and transferred to the above mentioned image receiving sheet followed by color forming and fixing by a fixing apparatus. Thus, a clear bluish black copy was obtained at 160° C. The resulting image was not vanished at all even when rubbed with an eraser.

EXAMPLE 125

An image receiving sheet used here was prepared following the procedure of Example 124.

The same amounts of film forming agent, emulsifier, and water so in Example 24, the compound of Formula (2) i.e. color forming agent (B), 50 parts and myristic acid (color forming auxiliary agent) 25 parts were mixed, ground and coated on a paper to form an image receiving sheet.

A toner was prepared following the procedure as in Example 124 by using 40 parts of Crystal Violet Lactone (CVL) and 60 parts of p-cyanostyrene-styrene copolymer (cyanostyrene 43% and styrene 95.7%) (supplied by Denki Kagaku Kogyo), and further a developer was prepared in a way similar to Example 124. In the developer, the carrier was positively charged and the toner negatively charged. The developer was placed in a developing device of magnetic brushing type and a toner image was produced on a drum surface having a photosensitive layer according to NP system of Canon K.K. and the resulting toner image was transferred to the image receiving sheet and subjected to a color forming and fixing treatment to form a sharp blue copy at about 160° C.

EXAMPLE 126

The same amounts of film forming agent, emulsifier and water as those in Example 124, 50 parts of the polymer of Formula (3) (color forming agent B), and 25 parts of glycerol stearate (color forming auxiliary agent) were mixed, ground and coated on a paper in a way similar to Example 124 to produce an image receiving sheet.

Toner was produced by using 40 parts of rhodamine lactone (RL) and 60 parts of polyester resin (trade name, XPL 2005, supplied by Kao Atras) in a way similar to Example 124 and then a developer was produced. In the developer, the carrier was negatively charged and the toner positively charged.

Then the developer as obtained above was placed in a developing denice of magnetic brush type. A drum surface having a photoconductive ZnO was negatively charged, exposed to an original pattern to form an electrostatic latent image, and developed by using the above mentioned developer to form a toner image. The toner image was transferred to the image receiving spect and subjected to a color forming and fixing treatment at about 170° C. to produce a sharp red copy.

EXAMPLE 127

An image receiving sheet was prepared in a way similar to Example 124 by mixing the same amount of film forming agent, emulsifier, and water as those in Example 124, a polymer of Formula (4) (color forming agent B) 50 parts, and lauric dodecyamide (color forming auxiliary agent) 25 parts, grinding the mixture and coating on a paper.

As toner, leuco auramine (LA) was finely divided and a developer was prepared in a way similar to Example 124. In the developer, the carrier was negatively charged and the toner was positively charged. Then, the above mentioned developer was placed in a developer of magnetic brush type. A drum surface having photoconductive ZnO was negatively charged and exposed to an original light pattern, and the resulting electrostatic latent image was developed by the above-mentioned developing device to form a toner image, which was then transferred to the above-mentioned image receiving sheet and subjected to a color forming and fixing treatment at about 170° C. to form a sharp yellow copy.

EXAMPLE 128

The same amounts of film forming agent, emulsifier, and water as those in Example 124, a compound of Formula (1) (color forming agent B) 50 parts and methyl montanate (color forming auxiliary agent) 25 parts were mixed, ground, coated on a paper in a way similar to Example 124 to produce an image receiving sheet.

As a toner, there were used 40 parts of CVL and 60 parts of polyvinyl chloride resin (trade name, Denka Vinyl, supplied by Denki Kagaku Kogyo K.K.) in a way similar to Example 124 to produce a developing agent. In the developer, the carrier was positively charged and the toner was negatively charged.

The electrostatic latent image on the surface of the photosensitive was developed by the developing device according to Canon NP System to form a toner image. The resulting toner image was transferred to the image receiving sheet and subject to a color forming and fixing treatment, and the resulting clear blue copy was obtained at about 170° C.

EXAMPLE 129

A base paper was coated with a 2% aqueous solution of sodium alginate at an amount of 3 g./m$^2$. and then coated with a solution of phenol formaldehyde polymer (5 parts) and polyvinyl butyral (5 parts) in methyl ethyl ketone (100 parts) at an amount of 7g./m2. to produce an electrostatic paper, to which a high voltage pattern of +500 volt was applied by a needle electrode to form a charge pattern. This charge pattern was developed with a liquid developer as used in Example 15 and heated to form blue color at the toner image portion resulting in a completely fixed clear copy.

EXAMPLE 130

Crystal Violet Lactone as color forming agent A was placed in a pulverzier to pulverize to a particle size of 1–50 microns, preferred with 5–20 microns, and then particles incapable of passing a 200 mesh sieve were removed.

The particles thus sieved were mixed with iron powder as carrier. The amount of iron powder was 8–50 parts by weight, preferred with 10–20 parts by weight, per one part by weight of toner. Particle size of iron powder was 20–75 microns, preferred with 25–40 microns. A mixture of iron powder and toner was charged in a developing device of magnetic brush type. A printing paper used here was a paper on which a phenolic resin (trade name, Tamanol, supplied by Arakawa Rinsan) was coated together with an appropriate binder.

Whole surface of a photoconductive member of zinc oxide - binder resin was negatively charged, exposed to a light and dark pattern and then passed through a developing device. The toner particle attached to a negatively charged toner. The toner image on the zinc oxide paper as master sheet was thermally transferred to the printing paper coated with phenolic resin by thermal pressing according to a process as shown in FIG. 6, and a blue image was produced on the printing paper. By repeating the above procedure, 15 sheets of good copy were obtained and each of these sheets was not different from the first copy in point of image quality.

EXAMPLE 131

The same developer and image receiving sheet as those in Example 130 were used. On a rotating drum having a selenium photoconductive photosensitive layer, there was formed a toner image by a process comprising charging exposing and development. A printing paper coated with phenolic resin as previously heated to soften the phenolic resin layer. When the printing paper was contacted with the toner image to give a good image. From the same master sheet there were obtained 13 sheets of copy of good quality.

EXAMPLE 132

Leuco rhodamine (RL) as toner was pulverized to a particle size of 1–10 microns, and dispersed in Isopar H (trade name, supplied by ESSO Standard Oil) to produce a developer. According to the procedure in Example 130 and conventional method, a ZnO paper was negatively charged, exposed to form an electrostatic latent image in a form of mirror image with respect to the original pattern, and developed in a liquid developer. The resulting toner image on the ZnO paper was dried. Then there was obtained a colored image on a printing paper in a way similar to the method of Example 130. The color image was red image of good quality. From the toner image there were obtained 20 sheets of good copy.

EXAMPLE 133

80 parts of CVL and 20 parts of myristic acid were mixed and melted, and further procedure was effected in a way similar to Example 130. The color forming temperature was 60° C. The color tone was not different from that of Example 130 at all. From one master sheet there were obtained 10 sheets of copy.

EXAMPLE 134

Leuco auramine as toner was used for preparing a developer according to a procedure as in Example 130. 4-Tertiary amylphenol 50 parts, styrene-butadiene latex 15 parts, polyvinylpyrrolidone 0.5 parts and water 34.5 parts were mixed and coated on a paper to produce a printing paper. In a way similar to Example 130, there were obtained 15 sheets of good copy.

EXAMPLE 135

A photosensitive member composed of polyester film (as insulating film) overlying on a photoconductive selenium was charged according to a Known method and selectively discharged to form a latent image. Then, a mixture of CVL 80 parts and polyamide resin 20 parts was melted and ground to a particle size of 1–20 microns. A master sheet was produced by a magnetic brush development and the image was transferred to a printing paper coated with phenolic resin in a way similar to Example 130. From this master sheet there were obtained 20 sheets of good copy.

EXAMPLE 136

Three sheets of photoconductive ZnO paper were negatively charged. By using an exposing device, the first ZnO paper was exposed through a red filter, the second ZnO paper through a green filter and the third ZnO paper through a blue filter to form each latent image. The first ZnO paper was developed by the same procedure as in Example 130 to form a toner image. The second ZnO paper was developed by rhodamine lactone to form a toner image. The third ZnO paper was developed by RA to form a toner image.

Bisphenol A 50 parts and diacetone acrylamide 50 parts were melted and mixed, and ground together with styrene-butadiene latex (trade name, DOW 636, supplied by Dow Chemical Co.) as binder, and then applied to a paper in the thickness of several microns to produce a printing paper. By using the apparatus as illustrated in FIG. 6, the above mentioned three ZnO paper having each toner image were subsequently pressed to the printing paper and heated to form color. Thus, multiple printing were effected on the printing paper to produce a colored image. The resulting image was almost similar to color image of the original. About 8 sheets of the multiprinting image were obtained.

We claim:

1. A receiving sheet for producing a low-temperature, heat-fixed, colored image from a colorless or light colored electrophotographic toner image containing a color forming agent (A), said receiving sheet consisting essentially of:

a color forming agent (B) selected from the group consisting of rosin modified maleic acid resin, hydrolyzed product of copolymer of styrene and maleic anhydride, hydrolyzed product of polymer of carboxy polyethylene, hydrolyzed product of copolymer of vinyl methyl ether and maleic anhydride, hydrolyzed product of copolymer of ethylene and maleic anhydride, Japanese acid clay, bentonite, diatomaceous earth, and phenolic material; and a material having a melting point ranging from 40–130° C. selected from the group consisting of fatty acid, fatty acid metal salt, fatty acid ester, fatty acid amide, diphenyl phthalate, dicyclohexyl phthalate, ethylene glycol dibenzoate and dimethyl isophthalate;

wherein said receiving sheet contains 10–30 parts of said material having a melting point ranging from 40–130° C. per 50 parts of said color forming agent (B);

and wherein said color forming agent (B) is adapted to react with the color forming agent (A) in the toner image upon heating to produce said low-temperature, heat fixed, colored image.

2. An electrostatic recording sheet for producing a low-temperature, heat-fixed, colored image from a colorless or light colored toner image formed thereon, said recording sheet consisting essentially of:

a support; and an electrostatic recording layer for forming an electrostatic latent image which, when treated with a toner containing a color forming agent (A), forms the colorless or light colored toner image, said recording layer consisting essentially of a color forming agent (B) selected from the group consisting of rosin modified maleic acid resin, hydrolyzed product of copolymer of styrene and maleic anhydride, hydrolyzed product of polymer of carboxy polyethylene, hydrolyzed product of copolymer of vinyl methyl ether and maleic anhydride, hydrolyzed product of copolymer of ethylene and maleic anhydride, Japanese acid clay, bentonite, diatomaceous earth, and phenolic material; and a material having a melting point ranging from 40–130° C selected from the group consisting of fatty acid, fatty acid metal salt, fatty acid ester, fatty acid anilide diphenyl phthalate, dicyclohexyl phthalate, ethylene glycol dibenzoate and dimethyl isophthalate;

wherein said recording layer contains 10–30 parts of said material having a melting point ranging from 40–130° C. per 50 parts of said color forming agent (B);

and wherein said color forming agent (B) is adapted to react with the color forming agent (A) in the toner image upon heating to produce said low-temperature, heat-fixed, colored image.

3. The electrostatic recording sheet according to claim 2 in which the phenolic material is a polymer of phenol and aldehyde.

4. The electrostatic recording sheet of claim 2 in which the phenolic material is a polymer of phenol and acetylene.

5. The electrostatic recording sheet of claim 2 in which the phenolic material is a bisphenol compound containing carboxyl radical in the molecule.

6. The electrostatic recording sheet of claim 2 in which the phenolic material is a polymer of a bisphenol compound containing carboxyl radical in the molecule.

7. The electrostatic recording sheet of claim 2 in which the fatty acid amide is a fatty acid anilide.

8. An electrostatic recording sheet according to claim 2 in which the phenolic material is selected from the group consisting of 4-t-bytylphenol, 4-β-t-amylphenol, 4-phenylphenol, 4,4'-isopropylidene-bis-(2-chlorophenol), 4,4'-isopropylidenebis-(2-methylphenol), 4,4'-isopropylidene-bis-(2-t-butylphenol), 4,4'-sec-butylidene-bis-(2-methylphenol), 2,2'-dihydroxydiphenyl, 4-t-octyl catechol, 4-hydroxyacetophenone, methyl-4-hydroxybenzoate, 4-hydroxydiphenoxide, α-naphthol, β-naphthol, 4-hydroxy diphenyloxide, 2,2'-methylene-bis-(4-chlorophenol), 2,2'-methylene-bis(4-methyl-6-t-butylphenol), 4,4'-isopropylidene bis-(2,6-dibromophenol), 4,4'-isopropylidene bis-(2,6-dichlorophenol), 4,4'-isopropylidene bis-(2,6-dimethylphenol), 4,4'-cyclohexylidene diphenol, and 4,4'-cyclohexylidene bis-(2-methylphenol).

9. An electrostatic recording sheet according to claim 2 in which the phenolic material is a bisphenol compound containing carboxyl radical in a molecule and its polymer selected from the group consisting of:

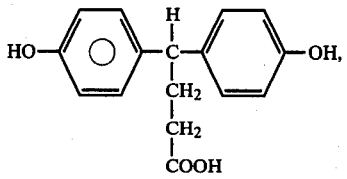

-continued

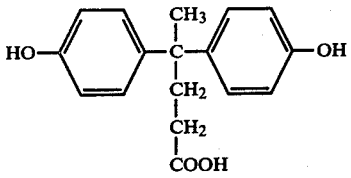

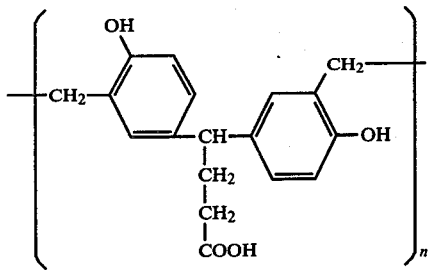

, and

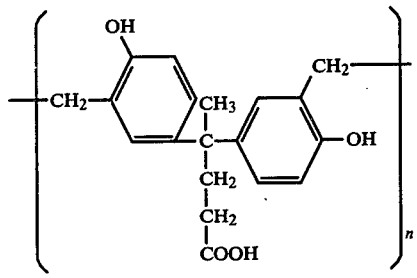

.

10. An electrostatic recording sheet according to claim 2 in which the fatty acid has not less than 12 carbon atoms and melting point ranging from 40 to 100° C.

11. An electrostatic recording sheet according to claim 2 in which the fatty acid is selected from the group consisting of lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid and lacceric acid.

12. An electrostatic recording sheet according to claim 2 in which the metal of the fatty acid metal salt is selected from the group consisting of Be, Mg, Ba, Zn, Cd, Hg, Al, Tl, and Pb.

13. An electrostatic recording sheet according to claim 2 in which the fatty acid amide is selected from the group consisting of fatty acid methyl amide and fatty acid dodecyl amide.

14. An electrostatic recording sheet according to claim 2 in which the fatty acid ester is selected from the group consisting of methyl ester, ethyl ester, phenyl ester, glycol ester, and glycerine ester of fatty acid.

15. An electrophotographic recording sheet for producing a low-temperature, heat-fixed, colored image from a colorless or light colored toner image formed thereon, said recording sheet consisting essentially of:

a support; and an electrophotoconductive layer for forming an electrophotographic latent image which, when treated with a toner containing a color forming agent (A), forms the colorless or light colored toner image, said layer consisting essentially of a color forming agent (B) selected from the group consisting of rosin modified maleic acid resin, hydrolyzed product of copolymer of styrene and maleic anhydride, hydrolyzed product of polymer of carboxy polyethylene, hydrolyzed product of copolymer of vinyl metal ether and maleic anhydride, hydrolyzed product of copolymer of ethylene and maleic anhydride, Japanese acid clay, bentonite, diatomaceous earth, and phenolic material; and a material having a melting point ranging from 40–130° C. selected from the group consisting of fatty acid, fatty acid metal salt, fatty acid ester, fatty acid amide, diphenyl phthalate, dicyclohexyl phthalate, ethylene glycol dibenzoate and dimethyl isophthalate;

wherein said receiving sheet contains 10–30 parts of said material having a melting point ranging from 40–130° C. per 50 parts of said color forming agent (B);

and wherein said color forming agent (B) is adapted to react with the color forming agent (A) in the toner image upon heating to produce said low-temperature, heat-fixed, colored image.

16. An electrophotographic recording sheet according to claim 15 in which the phenolic material is selected from the group consisting of 4-t-butylphenol, 4-β-t-amylphenol, 4-phenylphenol, 4,4'-isopropylidene-bis-(2-chlorophenol), 4,4'-isopropylidene-bis-(2-methylphenol), 4,4'-isopropylidene-bis-(2-t-butylphenol), 4,4'-sec-butylidene-bis-(2-methylphenol), 2,2'-dihydroxydiphenyl, 4-t-octyl catechol, 4-hydroxyacetophenone, methyl-4-hydroxybenzoate, 4-hydroxydiphenoxide, α-naphthol, β-naphthol, 4-hydroxy diphenyloxide, 2,2'-methylene-bis-(4-chlorophenol), 2,2'-methylene-bis-(4-methyl-6-t-butylphenol), 4,4'-isopropylidene bis-(2,6-dibromophenol), 4,4'-isopropylidene bis-(2,6-dichlorophenol), 4,4'-isopropylidene bis-(2,6-dimethylphenol), 4,4'-cyclohexylidene diphenol, and 4,4'-cyclohexylidene bis-(2-methylphenol).

17. An electrophotographic recording sheet according to claim 15 in which the phenolic material is a bisphenol compound containing carboxyl radical in a molecule and its polymer selected from the group consisting of:

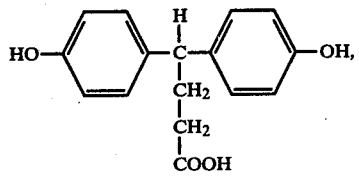

,

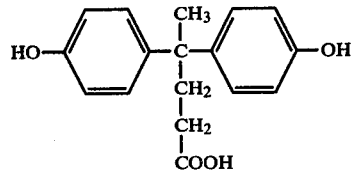

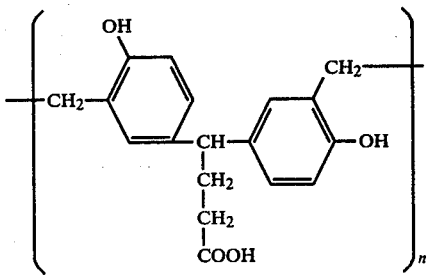

, and

-continued

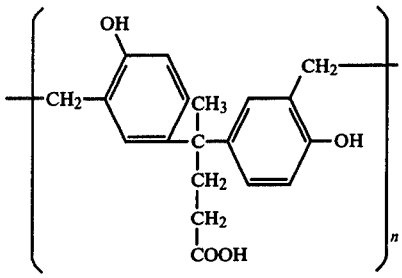

18. An electrophotographic recording sheet according to claim 15 in which the fatty acid has not less than 12 carbon atoms and has a melting point ranging from 40 to 100° C.

19. An electrophotographic recording paper according to claim 15 in which the fatty acid is selected from the group consisting of lauric acid, tridecylic acid, myristic acid, pentadecyclic acid, palmitic acid, heptadecylic acid, stearic acid, nonadecanoic acid, arachic acid, behenic acid, lignoceric acid, cerotic acid, heptacosanoic acid, montanic acid, melissic acid and lacceric acid.

20. An electrophotographic recording sheet according to claim 15 in which the metal of the fatty acid metal salt is selected from the group consisting of Be, Mg, Ba, Zn, Cd, Hg, Al, Tl, and Pb.

21. An electrophotographic recording sheet according to claim 15 in which the fatty acid amide is selected from the group consisting of fatty acid methyl amide and fatty acid dodecyl amide.

22. An electrophotographic recording sheet according to claim 15 in which the fatty acid ester is selected from the group consisting of methylester, ethyl ester, phenyl ester, glycol ester, and glycerine ester of fatty acid.

23. A receiving sheet for producing a low-temperature, heat-fixed, colored image from a colorless or light colored electrophotographic toner image containing a color forming agent (A), said receiving sheet consisting essentially of:

a binder;

a color forming agent (B) selected from the group consisting of, rosin modified maleic acid resin, hydrolyzed product of copolymer of styrene and maleic anhydride, hydrolyzed product of polymer of carboxyl polyethylene, hydrolyzed product of copolymer of vinyl methyl ether and maleic anhydride, hydrolyzed product of copolymer of ethylene and maleic anhydride, Japanese acid clay, bentonite, diatomaceous earth, and phenolic material; and a material having a melting point ranging from 40–130° C. selected from the group consisting of fatty acid, fatty acid metal salt, fatty acid ester, fatty acid amide, diphenyl phthalate, dicyclohexyl phthalate, ethylene glycol dibenzoate and dimethy isophthalate;

wherein said receiving sheet contains 10–30 parts of said material having a melting point ranging from 40–130° C. per 50 parts of said color forming agent (B);

and wherein said color forming agent (B) is adapted to react with the color forming agent (A) in the toner image upon heating to produce said low-temperature, heat-fixed, colored image.

24. The toner image receiving sheet according to claim 23 in which the phenolic material is a polymer of phenol and aldehyde.

25. The toner image receiving sheet according to claim 23 in which the phenolic material is a polymer of phenol and acetylene.

26. The toner image receiving sheet according to claim 23 in which the phenolic material is a bisphenol compound containing carboxyl radical in the molecule.

27. The toner image receiving sheet according to claim 23 in which the phenolic material is a polymer of a bisphenol compound containing carboxyl radical in the molecule.

28. The toner image receiving sheet according to claim 23 in which the fatty acid amide is a fatty acid anilide.

29. A receiving sheet according to claim 23 in which the phenolic material is selected from the group consisting of 4-t-butylphenol, 4-β-t-amylphenol, 4-phenylphenol, 4,4'-isopropylidene-bis-(2-chlorophenol), 4,4'-isopropylidene-bis-(2-methylphenol), 4,4'-isopropylidene-bis-(2-t-butylphenol), 4,4'-sec-butylidene-bis-(2-methylphenol), 2,2'-dihydroxydiphenyl, 4-t-octyl catechol, 4-hydroxyacetophenone, methyl-4-hydroxybenzoate, 4-hydroxydiphenoxide, α-naphthol, β-naphthol, 4-hydroxydiphenyloxide, 2,2'-methylene-bis-(4-chlorophenol), 2,2'-methylene-bis-(4-methyl-6-t-butylphenol), 4,4'-isopropylidene-bis-(2,6-dibromophenol), 4,4'-isopropylidene-bis-(2,6-dichlorophenol), 4,4'-isopropylidene-bis-(2,6-dimethylphenol), 4,4'-cyclohexylidene diphenol, and 4,4'-cyclohexylidine bis-(2-methylphenol).

30. A receiving sheet according to claim 23 in which the phenolic material is a bisphenol compound containing carboxyl radical in a molecule and its polymer selected from the group consisting of:

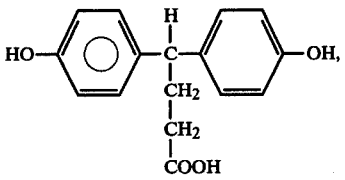

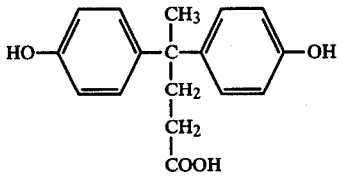

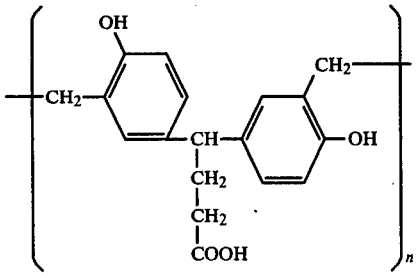

, and

-continued

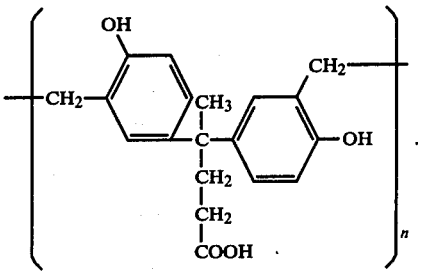

31. A receiving sheet according to claim 23 in which the fatty acid has 12 or more carbon atoms and a melting point ranging from 40 to 100° C.

32. A receiving sheet according to claim 23 in which the fatty acid is selected from the group consisting of lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid and lacceric acid.

33. A receiving sheet according to claim 23 in which the metal of the fatty acid metal salt is selected from the group consisting of Be, Mg,. Ba, Zn, Cd, Hg, Al, T1, and Pb.

34. A receiving sheet according to claim 23 in which the fatty acid amide is selected from the group consisting of fatty acid methyl amide and fatty acid dodecyl amide.

35. A receiving sheet according to claim 23 in which the fatty acid ester is selected from the group consisting of methyl ester, ethyl ester, phenyl ester, glycol ester and glycerine ester of the fatty acid.

36. A receiving sheet according to claim 23 in which the binder is selected from the group consisting of styrene-butadiene latex, polyvinyl pyrrolidone, acryl latex, polyvinyl alcohol, polyvinyl acetate and polyvinyl butyral.

37. An electrostatic recording sheet for producing a low-temperature, heat-fixed, colored image from a colorless or light colored toner image formed thereon, said recording sheet consisting essentially of:

a support; and an electrostatic recording layer for forming an electrostatic latent image which, when treated with a toner containing a color forming agent (A), forms the colorless or light colored toner image, said recording layer consisting essentially of a resin binder, a color forming agent (B) selected from the group consisting of rosin modified maleic acid resin, hydrolyzed product of copolymer of styrene and maleic anhydride, hydrolyzed product of polymer of carboxy polyethylene, hydrolyzed product of copolymer of vinyl methyl ether and maleic anhydride, hydrolyzed product of copolymer of ethylene and maleic anhydride, Japanese acid clay, bentonite, diatomaceous earth, and phenolic material; and a material having a melting point ranging from 40–130° C.selected from the group consisting of fatty acid, fatty acid metal salt, fatty acid ester, fatty acid amide, diphenyl phthalate, dicyclohexyl phthalate, ethylene glycol dibenzoate and dimethyl isophthalate;

wherein said recording layer contains 10–30 parts of said material having a melting point ranging from 40–130° C.per 50 parts of said color forming agent (B);

and wherein said color forming agent (B) is adapted to react with the color forming agent (A) in the toner image upon heating to produce said low-temperature, heat-fixed, colored image.

38. An electrophotographic recording sheet for producing a low-temperature, heat-fixed, colored image from a colorless or light colored toner image formed thereon, said recording sheet consisting essentially of:

a support; and an electrophotoconductive layer for forming an electrophotographic latent image which, when treated with a toner containing a color forming agent (A), forms the colorless or light colored toner image, said layer consisting essentially of:

a resin binder;

a color forming agent (B) selected from the group consisting of rosin modified maleic acid resin, hydrolyzed product of copolymer of styrene and maleic anhydride, hydrolyzed product of polymer of carboxy polyethylene, hydrolyzed product of copolymer of vinyl methyl ether and maleic anhydride, hydrolyzed product of copolymer of ethylene and maleic anhydride, Japanese acid clay, bentonite, diatomaceous earth, and phenolic material; and a material having a melting point ranging from 40–130° C. selected from the group consisting of fatty acid, fatty acid metal salt, fatty acid ester, fatty acid amide, diphenyl phthalate, dicyclohexyl phthalate, ethylene glycol dibenzoate and dimethyl isophthalate;

wherein said receiving sheet contains 10–30 parts of said material having a melting point ranging from 40–130° C. per 50 parts of said color forming agent (B);

and wherein said color forming agent (B) is adapted to react with the color forming agent (A) in the toner image upon heating to product said low-temperature, heat-fixed, colored image.

* * * * *

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 3, line 65, delete "the" (first occurrence)

Col. 4, line 9, after "forming" delete "surface with a charged toner particle contain"

Col. 4, line 10, delete "ing a color forming"

Col. 4, line 15, delete "a"

Col. 4, line 23, "apect" is --aspect--

Col. 4, line 27, "gent" should be --agent--

Col. 4, line 45, "4)" should be --40--

Col. 4, line 49, "invenion" should be --invention--

Col. 5, line 45, after "plasticizer", insert --.-- and delete ","

Col. 5, line 52, "3 rosin" should be --3. rosin--

Col. 5, line 66, "contaning" is --containing--

Col. 6, line 31, "containing's" is --containing--

Col. 6, line 45, after "procedure" insert --;--

Col. 7, line 30, after "carbinols" insert --:--

Col. 7, line 37, "benzoidolino" is --benzoindolino--

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 8, line 43, "isopropylidine" is --isopropylidene--

Col. 8, line 40, "tertitary" is --tertiary--

Col. 9, line 25, " 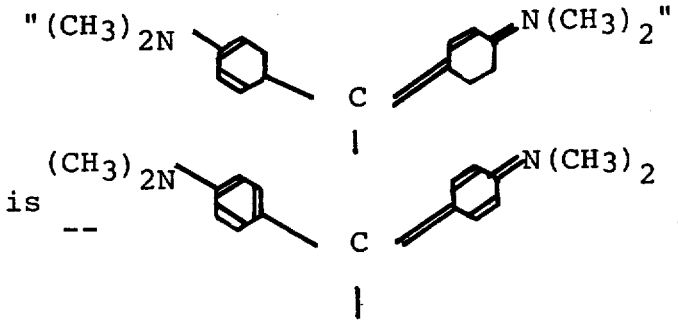 " is ----

Col. 9, line 50, "elctrophotographic" is --electrophotographic--

Col. 9, line 53, "Cds" is --CdS--

Col. 11, line 36, "65.50" is --68.5--

Col. 11, line 48, "51 5" is --51.5--

Col. 12, line 19, "amilide" is --anilide--

Col. 9, line 40, " 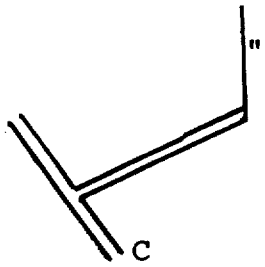 " is -- 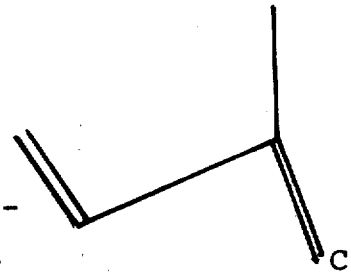 --

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 13, Table 1, line 7, "CLD" is --CVL--

Col. 13, Table 1, line 15, "non" 6 occurrences, is --none--

Col. 14, line 13, "mater" is --matter--

Col. 15, Table 2, line 6, "CVD" is --CVL--

Col. 18, Table 5, Columns 60, 61, 63, delete ".05 .08_" and insert --.03 .05 .08--

Col. 21, Table 10, Column 116, "2000" is --220--

Col. 21, Table 11, Column 117 118 122 123 124 (Pulverizing)
" 0 0 0 0 0 " should be
--◎ ◎ ◎ ◎ ◎--

Col. 21, Table 11, after "Blur", in Columns

| 119 | 120 | 121 | 125 | 126 | |
|---|---|---|---|---|---|
| "a little" | "exist" | "none" | " a little" | _____ | should be |
| --none-- | a little-- | exist- | --none-- | --a little-- | |

Col. 23, line 44, "optical" is --optional--

Col. 24, line 55, "little" is --small--

Col. 25, Table 13, "Low 686" is --Dow 686--

Col. 25, Table 14, "Now" is --Dow--

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 25, Table 15, "Low" is --Dow--

Col. 25, Table 16, "Low" is --Dow--

Col. 25, Tables 13, 14, 15, "treated resin" is --treated rosin--

Col. 25, 26, Table 15, after "agent B", delete --50-- (9 occurrences)

Col. 27, Table 16, "Low" is --Dow--

Col. 27, Table 17, "Bresinate" is --Dresinate--

Col. 29, Table 18, after "toner", delete "28°C" and insert --230°C--

Col. 31, line 23, "dicharging" is --discharging--

Col. 34, line 57, "11" is --1ℓ--

Col. 34, line 61, "21" is--2ℓ --

Col. 35, line 54, "softing point" is --softening point--

Col. 37, line 6, "nd" is --and--

Col. 37, line 25, "Crustal Niolet" is --Crystal Violet--

Col. 37, line 47, "butadien" is --butadiene--

Col. 38, line 21, "797" is --79.7--

Col. 39, line 8, "30-30" is --3-30--

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 39, line 38, "spire" is --spiro--

Col. 40, line 5, "1.1" is --1,1--

Col. 40, line 54, "chargable" is --chargeable--

Col. 41, line 19, "797" is --79.7--

Col. 42, line 51, "11" is --1ℓ--

Col. 42, line 54 "2 1 " should be --2ℓ--

Col. 44, line 20, "leau" is --lead--

Col. 44, line 35, after "in the" insert --mixture of the--

Col. 44, line 56, "wight" is --weight--

Col. 45, line 66, after "resin" insert --(--

Col. 47, line 29, "1 1" is --1ℓ--

Col. 47, line 31, "2 1" is --2ℓ--

Col. 48, line 39, "beneate" is --behenate--

Col. 48, line 28, "Malacoite" is --Malachite--

Col. 48, line 67, "beneate" is --behenate--

Col. 49, line 8, "1 1" is --1ℓ--

Col. 49, line 10, "this" is --This--

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 49, line 11, "2 l" is --2ℓ--

Col. 50, line 44, "vibratng" is --vibrating--

Col. 53, line 67, "laten" is --latent--

Col. 54, line 20, "Picoolastic" is --Piccolastic--

Col. 55, line 1, "1 l" is --1ℓ--

Col. 55, line 4, "2 l" is --2ℓ--

Col. 55, line 47, "butadienecopolymer" is --butadiene copolymer--

Col. 56, line 42, "ws" is --was--

Col. 57, line 6, "mixer" is --mixture--

Col. 57, line 12, "ws" is --was--

Col. 57, line 20, "electrophtographic" is --electrophotographic--

Col. 58, line 65, "deveoping" is --developing--

Col. 59, line 43, "ws" is --was--

Col. 59, line 50,"perferably" is --preferably--

Col. 60, line 9, "the" is --The--

Col. 60, line 31, "negativey" is --negatively--

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 60, line 48, after "adding" insert --50--

Col. 60, line 58, "after" is --After--

Col. 61, line 7, "ehs ame" is --the same--

Col. 61, line 10, "dveloping" is --developing--

Col. 61, line 65, "dveloping" is --developing--

Col. 61, line 42, "(Daesinate" is --(Dresinate--

Col. 62, line 26, "dveloping" is --developing--

Col. 62, line 49, "insuating" is --insulating--

Col. 62, line 51, "devloping" is --developing--

Col. 62, line 61, "foremd" is --formed--

Col. 63, line 3, "4 part of ZnO, 2 part" is --4 parts of ZnO, 2 parts--

Col. 63, line 45, "Creen" is --Green--

Col. 63, line 47, "riccolastic B" is --Piccolastic D--

Col. 64, line 45, "70:70" is --70:30--

Col. 64, line 55, "Japanene" is --Japanese--

Col. 65, line 17, "11" is --1ℓ--

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 65, line 19, "21" is --2ℓ--

Col. 66, Table 19, in Example No. 83, under "Color Forming Agent" after "Malachite Green" insert --lactone--

Col. 66, Table 19, after Example No. 92, under "Color Forming Agent" delete "Methoxyincolino-" and insert --Methoxyindolino--

Col. 67, Table 19, after Example No. 92, under "Color Forming Agent" delete "xasthene" and insert --xanthene--

Col. 67, Table 19, after Example No. 95, under "Color Forming Agent" delete "g-amino" and insert --p-amino--

Col. 67, Table 20, "Iember" is --member--

Col. 67, Table 20, "Thenol" is --Phenol--

Col. 67, Table 20, "acctylene" is --acetylene--

Col. 68, line 62, "11" is --1ℓ--

Col. 68, line 65, "21" is --2ℓ--

Col. 69, line 48, "OPBA" is --DPBA--

Col. 69, line 52,"bail" is --ball--

Col. 70, line 54, "denice" is --device--

Col. 70, line 59, "spect" is --sheet--

Col. 70, line 68, "dodecyamide" is --dodecylamide--

UNITED STATES PATENT AND TRADEMARK OFFICE

CERTIFICATE OF CORRECTION

PATENT NO. : 4,148,968

DATED : April 10, 1979

INVENTOR(S) : SHINICHIRO NAGASHIMA ET AL

It is certified that error appears in the above—identified patent and that said Letters Patent is hereby corrected as shown below:

Col. 71, line 55, "pulverzier" is --pulverizer--

Col. 72, line 20, "as" is --was--

Col. 72, line 21, "When" is --Then--

Col. 72, line 62, "Known" is --known--

Signed and Sealed this

*Twenty-sixth* Day of *February 1980*

[SEAL]

*Attest:*

SIDNEY A. DIAMOND

*Attesting Officer*

*Commissioner of Patents and Trademarks*